US006244834B1

(12) United States Patent
Matsuda et al.

(10) Patent No.: US 6,244,834 B1
(45) Date of Patent: Jun. 12, 2001

(54) VARIABLE CAPACITY-TYPE SCROLL COMPRESSOR

(75) Inventors: Mikio Matsuda; Mitsuo Inagaki; Takashi Inoue; Shigeki Iwanami, all of Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/384,235

(22) Filed: Aug. 27, 1999

(30) Foreign Application Priority Data

Jan. 30, 1998 (JP) ..... 10-019614

(51) Int. Cl.[7] ..... F04B 49/00; F04B 23/00
(52) U.S. Cl. ..... 417/292; 417/440
(58) Field of Search ..... 417/292, 293, 417/294, 440

(56) References Cited

U.S. PATENT DOCUMENTS 5,040,952 * 8/1991 Inoue et al. ..... 417/312
5,362,211 * 11/1994 Iizuka et al. ..... 417/440
5,639,255 * 6/1997 Matsuda et al. ..... 417/299
5,759,021 * 6/1998 Yamaguchi et al. ..... 418/55.3
5,860,791 * 1/1999 Kikuchi ..... 417/310

FOREIGN PATENT DOCUMENTS 58-101287 6/1983 (JP) .
62-67288 3/1987 (JP) .
3-33486 2/1991 (JP) .

* cited by examiner

*Primary Examiner*—Timothy S. Thorpe
*Assistant Examiner*—Michael K. Gray
(74) *Attorney, Agent, or Firm*—Pillsbury Winthrop LLP

(57) ABSTRACT

A compressor of scroll type or the like, in which, in order to change the discharge capacity automatically in accordance with the rpm (rotational speed) of a shaft (4) by simple means, the centrifugal force exerted on a movable scroll (9) orbiting with the rotation of the shaft (4) is used as a vibratory force to forcibly vibrate a spool (23) constituting a valve body supported on an elastic member (25), thereby opening and closing bypass holes (22) for establishing communication between a working chamber (V) and a suction chamber (15).

9 Claims, 37 Drawing Sheets

VARIABLE CAPACITY-TYPE SCROLL COMPRESSOR

TECHNICAL FIELD

The present invention relates to a variable capacity-type scroll compressor effectively applicable to a compressor required to change the discharge capacity thereof in accordance with the driving rotational speed (the rotational speed of the drive shaft).

BACKGROUND ART

A scroll-type compressor described in Japanese Unexamined Patent Publications (Kokai) Nos. 3-33486 and 58-101287 as a variable capacity-type compressor comprises a bypass hole formed at the end plate of a fixed scroll for establishing the communication between the compressor working chamber and the suction side, wherein by opening and closing the bypass hole, the discharge capacity of the compressor is variable. For opening and closing the bypass hole, a solenoid valve or valve means utilizing the differential pressure between the suction pressure and the discharge pressure is used.

The means described above, however, increases the number of parts constituting the variable capacity-type compressor and complicates the structure thereof. The problem is posed, therefore, that the manufacturing cost of the variable capacity-type compressor may be increased and the reliability (durability) thereof may be reduced.

DISCLOSURE OF THE INVENTION

In view of the problem point described above, the object of the present invention is to provide a variable capacity-type scroll compressor in which the discharge capacity can be changed by simple means.

In order to achieve the object described above, the present invention uses the following technical means.

The invention is characterized by a configuration in which a valve body (23) for opening or closing a bypass hole (22) is forcibly vibrated under a vibratory force generated with the rotation of the shaft (4) through an elastic member (25).

As a result, the valve body (23) is vibrated (displaced) based on the natural frequency $\omega_0$ determined by the mass of the valve body (23) and the elastic constant of the elastic member (25). In the case were the vibration frequency of the movable portion such as a movable scroll (9), i.e. the number of revolutions per unit time $\omega$ (i.e. the rotational speed) of the shaft 4 is sufficiently small as compared with the natural frequency $\omega_0$, therefore, as described later, the valve body (23) vibrates with substantially the same phase and amplitude as the movable scroll (9). Specifically, in the case where the bypass hole (22) is closed with the shaft (4) kept stationary, the closed state is maintained, while if the bypass hole (22) is opened in that state, the open state is maintained.

In the case where the rotational speed of the shaft (4) and the orbital vibration frequency $\omega$ of the movable scroll (9) have become sufficiently large as compared with the natural frequency $\omega_0$, the valve body (23) is vibrated (displaced) relative to the movable scroll (9) and the bypass hole (22). The bypass hole (22) thus is opened and closed by the valve body (23). The valve body (23) can open or close the bypass hole (22), therefore, by selecting an appropriate natural frequency $\omega_0$.

As described above, according to this invention, the bypass hole (22) can be opened and closed by simple means in which the natural frequency $\omega_0$ of the vibration system including the valve body (23) and the elastic member (25) is set to a predetermined value and the valve body (23) is forcibly vibrated by the shaft (4) through the elastic member (25). By doing so, the discharge capacity of the compressor can be changed. Thus, the manufacturing cost of the compressor can be reduced and the reliability (durability) thereof can be improved.

The invention in an aspect is characterized in that the elastic constant of the elastic member is changed in accordance with the fluid temperature on the fluid suction side.

As a result, the open/close timing of the bypass hole (22) can be controlled based on the fluid temperature on the fluid suction side. As described later, therefore, in the case where the variable capacity-type compressor according to this invention is applied to the refrigeration cycle, the open/close timing of the bypass hole (22) can be controlled in accordance with the thermal load on the evaporator.

By the way, the elastic member can be configured as a fluid spring by introducing the fluid of the fluid suction side.

Also, the elastic member may be formed of a shape memory alloy the shape of which is changed in accordance with the atmospheric temperature. By the way, in this case, the elastic member of a shape memory alloy is desirably exposed directly to the fluid on the fluid suction side.

Also, a plurality of valve bodies **(23*a*, 23*b*) and elastic members (25*a*, 25*b*) may be provided and the natural frequency determined by the elastic constant of the valve bodies (23*a*, 23*b*) and the elastic members (25*a*, 25*b*)** may be set to different values. By doing so, the open/close operation of the bypass hole can be controlled in multiple stages.

Also, the value body (23) may be configured in such a manner as to receive the vibratory force from the end plate portion **(9*b*) of the movable scroll (9). Also, the valve body (23) may be configured so as to close the bypass hole (22) while the shaft (4)** is stationary.

By the way, the reference numerals in the parentheses for each means described above illustrate the correspondence with the specific means according to the embodiments described later.

BEST MODE FOR CARRYING OUT THE INVENTION (First Embodiment)

Figure 42:
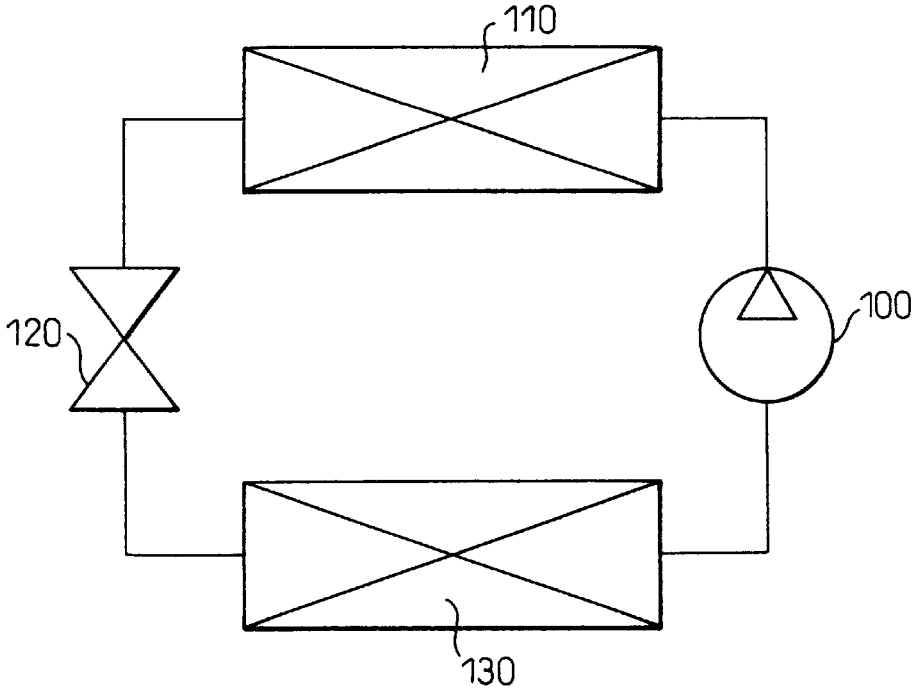
FIG. 42 is a model diagram showing a refrigeration cycle.

This embodiment is an application of a variable capacity-type compressor according to the present invention to a scroll-type compressor (hereinafter referred to simply as the compressor) of a vehicle refrigeration cycle. FIG. 42 is a model diagram of a vehicle refrigeration cycle using a compressor 100 according to this embodiment.

In FIG. 42, 110 designates a radiator (condenser) for cooling and condensing the refrigerant discharged from the compressor 100, and 120 is a pressure reducer for reducing the pressure of the refrigerant flowing out of the radiator 110. 130 designates an evaporator for evaporating the refrigerant in gas-liquid two-phase state flowing out of the pressure reducer 120. The refrigerant that has flowed out of the evaporator 130 is again sucked into and compressed by the compressor 100.

Next, the compressor 100 will be explained.

Figure 1:
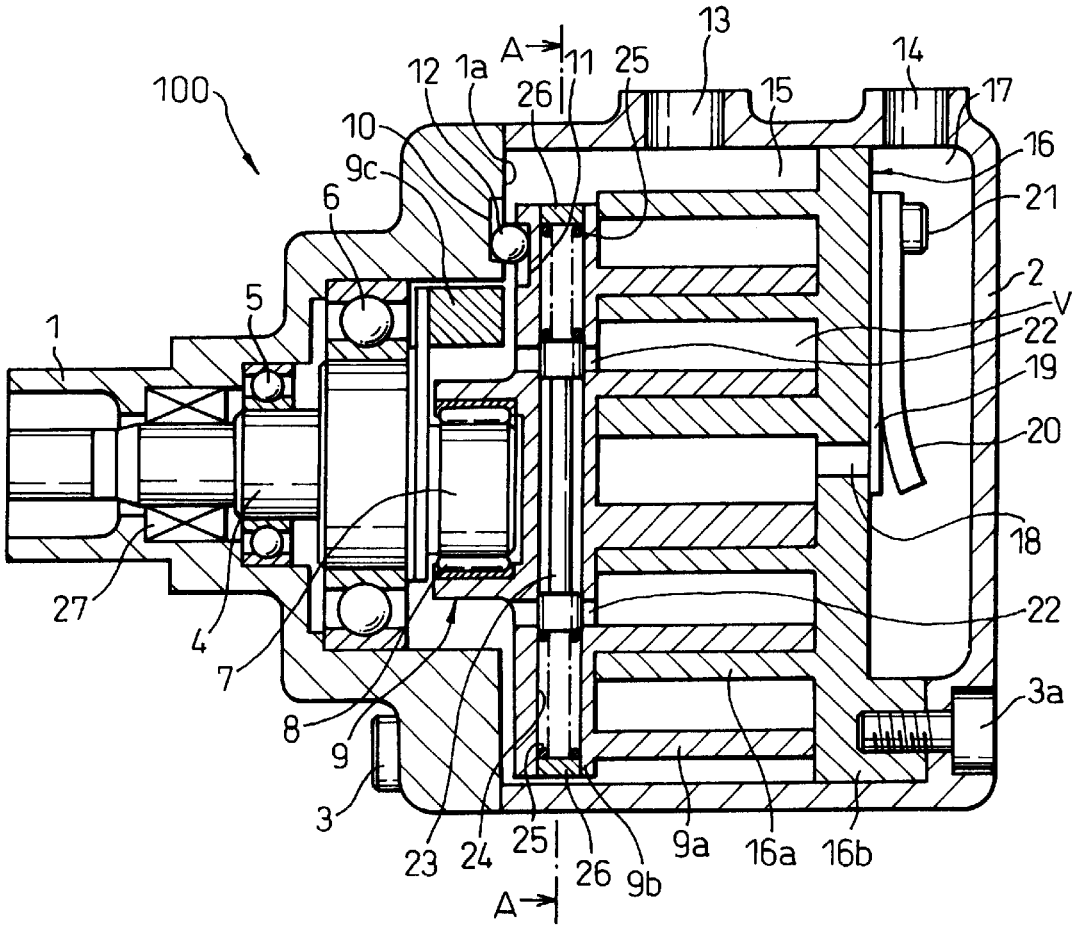
FIG. 1 is a longitudinal sectional view (sectional view taken in line B—B in FIG. 2) of a variable capacity-type scroll compressor according to a first embodiment.

FIG. 1 is a sectional view of the compressor 100. In the drawing, 1 designates a front housing and 2 a rear housing. Both housings 1, 2 are integrated by being fastened to each other by bolts 3. 4 designates a shaft rotated in the front housing 1. This shaft 4 normally receives the driving force from an external drive source (not shown) such as an engine or an electric motor through a driving force on/off means (not shown) such as a solenoid clutch. The shaft 4 is rotatably held on the front housing 1 by bearings (radial bearings) 5, 6.

7 designates a crank portion integrally coupled to the shaft 4 at a position a predetermined amount eccentric from the rotation center of the shaft 4. This crank portion 7 is rotatably coupled to a movable scroll (movable portion) 9 through a needle bearing 8 of a shell type (having no inner ring).

As is well known, the movable scroll 9 includes a spiral tooth portion 9*a* and an end plate portion 9*b* integrally formed with the tooth portion 9*a*. Circular recesses 10, 11 are formed in pairs at the end surface 1*a* opposed to the end plate of the front housing 1 portion 9*b* and the end plate portion.

A steel ball 12 is arranged between the recess pair 10, 11. The steel ball 12 and the recess pair 10, 11 constitute what is called an antirotation mechanism for preventing the rotation of the movable scroll 9 around the rotation center of the shaft 4. Therefore, with the rotation of the shaft 4, the movable scroll 9 orbits, without rotation, around the shaft 4 with the amount of eccentricity of the crank portion 7 as a orbiting radius.

By the way, 9*c* designates a balancer for offsetting the centrifugal force exerted on the shaft 4 as a result of orbiting of the movable scroll 9. This balancer 9*c* is mounted on the shaft 4 always in a position far from the gravitational center of the movable scroll located beyond the rotation center of the shaft 4, and rotates with the shaft 4.

Also, the rear housing 2 is formed with a suction port 13 and a discharge port 14. The suction port 13 communicates with a spacing (hereinafter referred to as the suction chamber) 15 formed by the front housing 1, the rear housing 2 and the end plate portion 16*b* of a fixed scroll 16 described later.

16 designates a fixed scroll (fixed portion) fixed on the rear housing 2 through a bolt 3*a*. This fixed scroll 16 includes a spiral tooth portion 16*a* in mesh with the tooth portion 9*a* of the movable scroll 9 for forming a working chamber V and the above-mentioned end plate portion 16*b* integrally formed with the tooth portion 16*a*.

As is well known, with the orbiting of the movable scroll 9, the working chamber V enlarges the capacity thereof while moving toward the center from the outer peripheral side of the scrolls 9, 16 in mesh with each other. In this way, the working chamber V sucks the refrigerant (generally, a compressable fluid) that has flowed into the suction chamber 15 from the suction port 13, and subsequently further moves toward the center while reducing the volume thereof thereby to compress the refrigerant.

17 designates a discharge chamber into which the refrigerant that has been compressed in the working chamber V is discharged. In this discharge chamber 17, the pressure pulsations in the discharged refrigerant are reduced. At the central portion of the end plate portion 16*b* of the fixed scroll 16, a discharge hole 18 is formed for establishing communication between the working chamber V of which the internal pressure has increased to the discharge pressure (with the volume reduced most) and the discharge chamber 17. A discharge valve 19 of reed valve type for preventing the reverse flow of the refrigerant into the working chamber V from the discharge chamber 17 is arranged on the discharge chamber 17 side of the discharge hole 18.

Note that, 20 designates a valve stop plate (stopper) for restricting the maximum opening degree of the discharge valve 19. This valve stopper 20 is fixed on the end plate portion 16*b* by a bolt 21 together with the discharge valve 19.

By the way, the end plate portion 9*b* of the movable scroll 9 is formed with two bypass holes 22 for establishing the communication between the suction chamber 15 and the working chamber V. These bypass holes 22 are opened and closed by a spool 23 constituting a valve body mounted radially on the end plate 9*b*.

Figure 2:
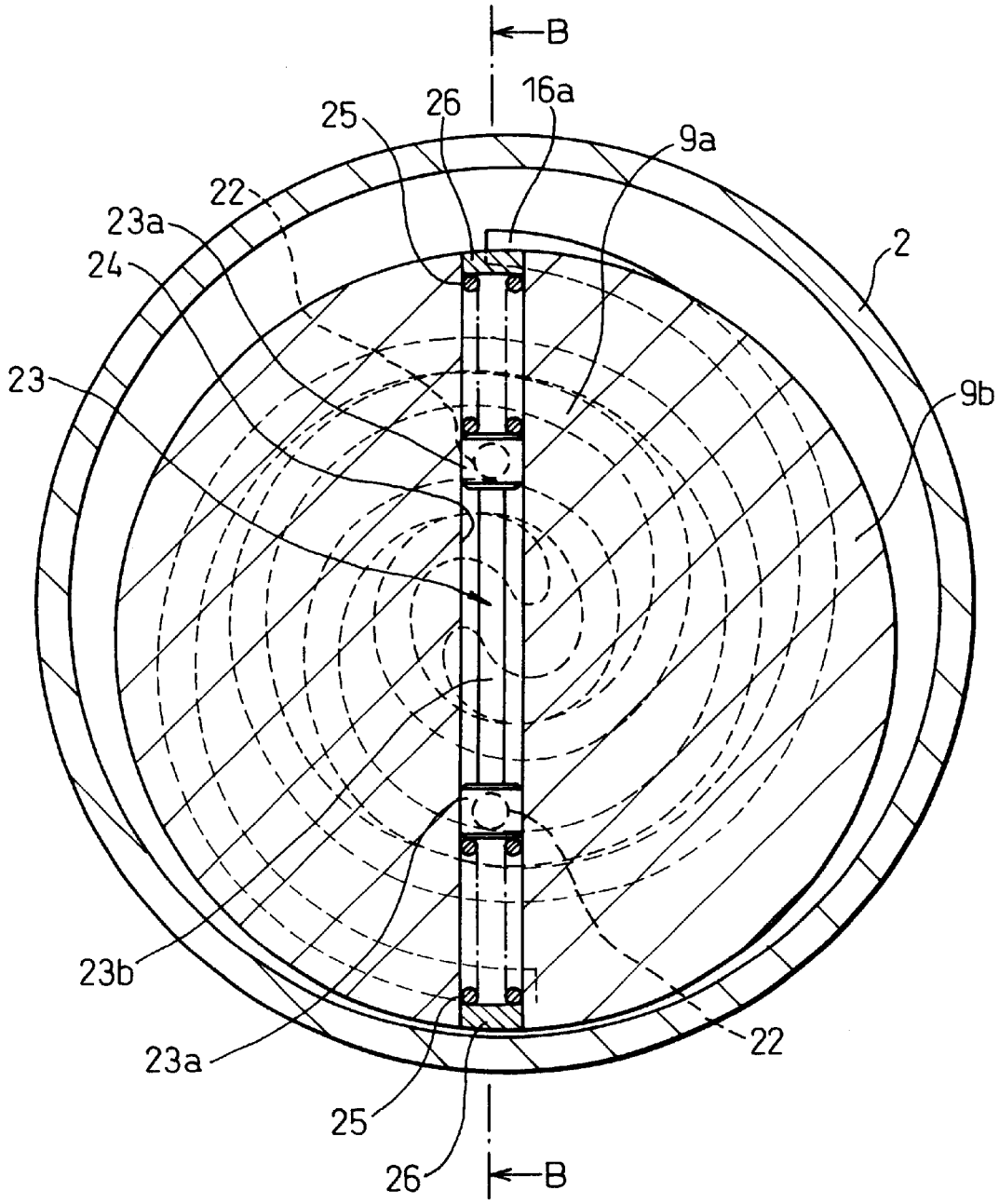
FIG. 2 is a sectional view taken in line A—A in FIG. 1.

This spool 23 is configured of, as shown in FIG. 2, two valve portions 23*a* for opening/closing the two bypass holes 22 and a coupling portion 23*b* for coupling these valve portions 23*a*. Also, the spool 23 is slidably inserted in a guide hole 24 formed in such a manner as to extend diametrically to the end plate portion 9*b*, while at the same time being pressed by two coil springs (elastic members) 25 toward the center from the diametrically outer side of the end plate portion 9*b*.

As a result, with the orbiting of the movable scroll 9, the spool 23 is forcibly vibrated by the vibratory force received from the movable scroll 9 through the coil springs 25.

By the way, the natural length of the coil springs 25 is set in such a manner that when the movable scroll 9 is stationary, the two valve bodies 23*a* of the spool 23 are stationary at a position where the bypass holes 22 are closed.

Also, 26 designates a lid (cap) for enclosing the guide hole 24, and 27 a lip seal for preventing the refrigerant from leaking out of the suction chamber 15 by way of the gap between the shaft 4 and the front housing 1.

Next, the operation and the features of the compressor 100 according to this embodiment will be explained.

The spool 23, as described above, is forcibly vibrated under the vibratory force received from the movable scroll 9 through the coil springs 25 with the orbiting of the movable scroll 9, and therefore the vibration of the spool 23 is a forcible one due to the displacement of one freedom system.

Figure 3A:
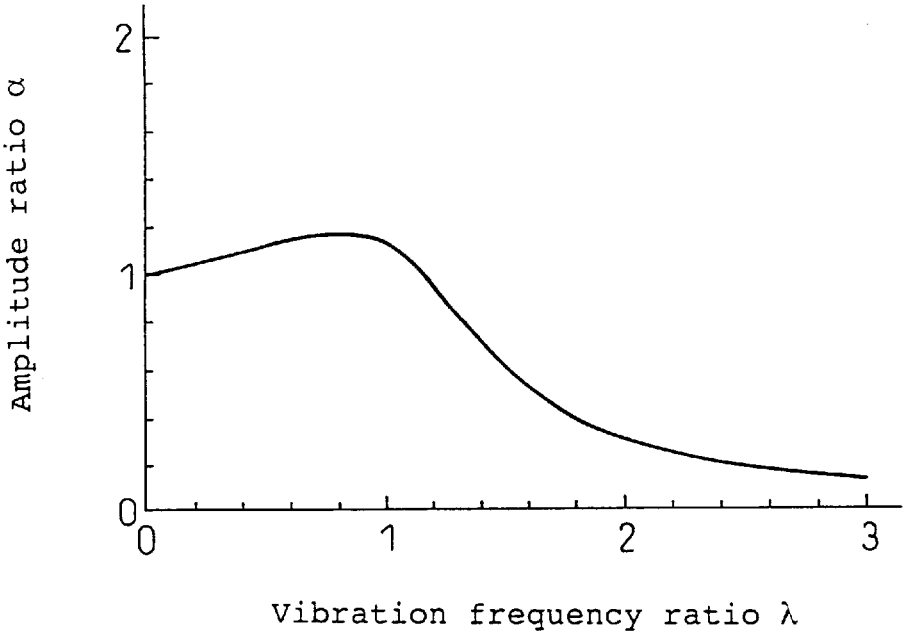
FIG. 3A is a graph showing the relation between the amplitude ratio and the vibration frequency ratio.
Figure 3B:
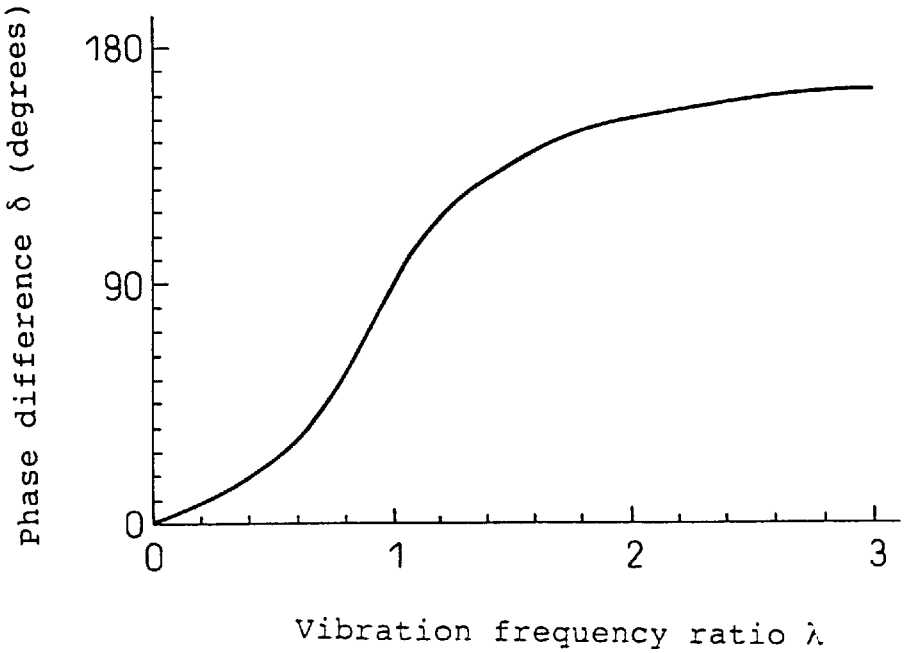
FIG. 3B is a graph showing the relation between the phase difference and the vibration frequency ratio.

Taking into account the viscous resistance offered by the lubricant, etc. when the spool 23 is displaced by vibration in the guide hole 24, therefore, the amplitude ratio $\alpha$ and the phase difference $\delta$ are indicated by equations (1) and (2) below, respectively, as is well known, where vibration frequency ratio $\omega/\omega_0$ is given as $\lambda$. Incidentally, FIG. 3A is a graph representing equation (1) and FIG. 3B is a graph representing equation (2).

$$\alpha=\{(1-\lambda^2)^2+(2\cdot\gamma\cdot\lambda)^2\}^{-1} \quad (1)$$

$$\delta=\tan^{-1}\{(2\cdot\gamma\cdot\lambda)/(1-\lambda^2)\} \quad (2)$$

where each symbol represents the following: $\omega$: Orbital vibration frequency of movable scroll 9

(i.e. rotational speed of shaft 4)

$\omega_0$: Inherent vibration frequency of vibration system including spool 23 and coil springs 25, where $\omega_0=(k/m)^{1/2}$ k: Spring constant (elastic constant) of coil springs 25 m: Mass of spool 23

$\gamma$: Viscous damping coefficient ratio (about 0.5 in this embodiment)

Figure 4:
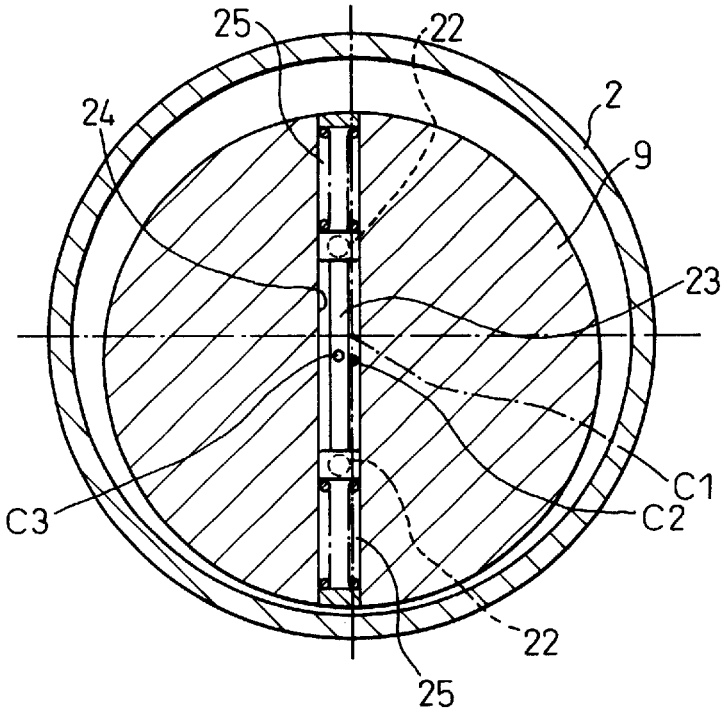
FIG. 4 is a sectional view taken in line A—A in FIG. 1 showing the operating condition $\lambda \ll 1$ of a variable capacity-type scroll compressor according to the first embodiment.
Figure 5:
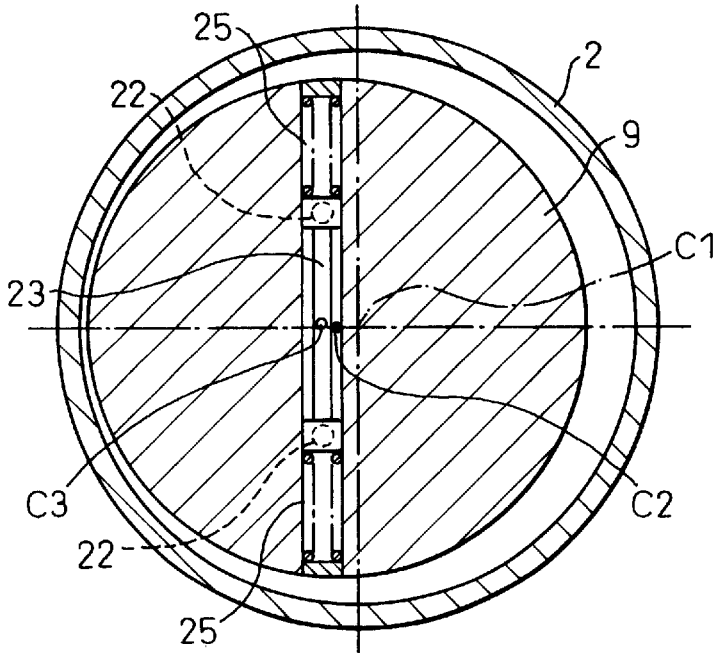
FIG. 5 is a sectional view taken in line A—A in FIG. 1 showing the state in which the movable scroll has orbited by 90° from the state of FIG. 4.
Figure 6:
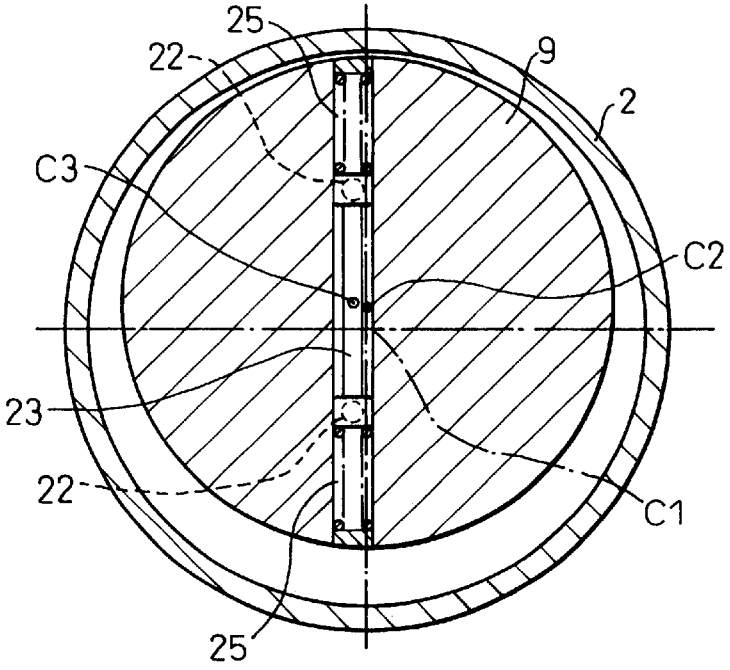
FIG. 6 is a sectional view taken in line A—A in FIG. 1 showing the state in which the movable scroll has orbited by 90° from the state of FIG. 5.
Figure 7:
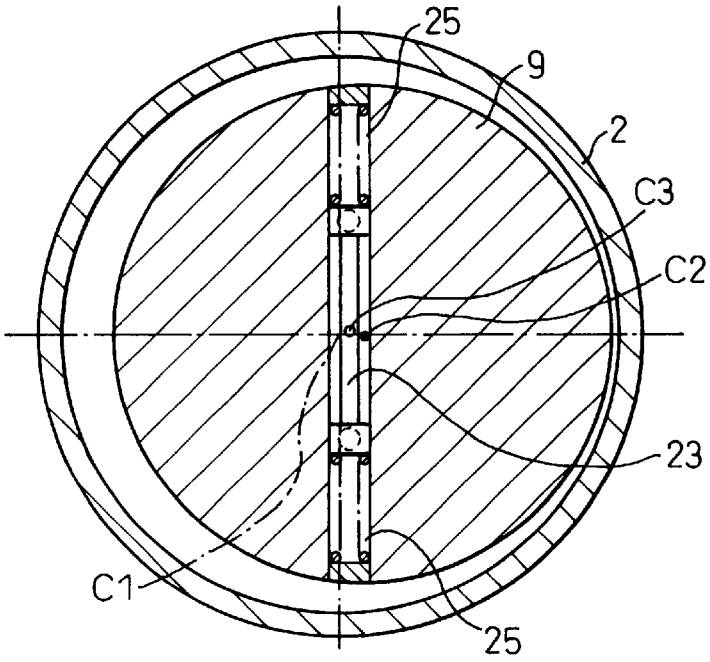
FIG. 7 is a sectional view taken in line A—A in FIG. 1 showing the state in which the movable scroll has orbited by 90° from the state of FIG. 6.
Figure 8:
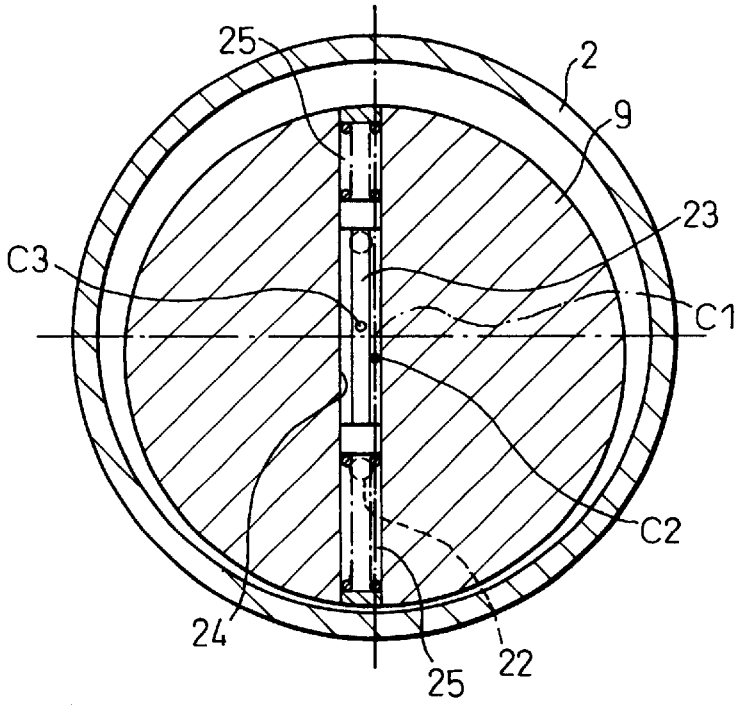
FIG. 8 is a sectional view taken in line A—A in FIG. 1 showing the operating condition $\lambda>>1$ of a variable capacity-type scroll compressor according to the first embodiment.
Figure 9:
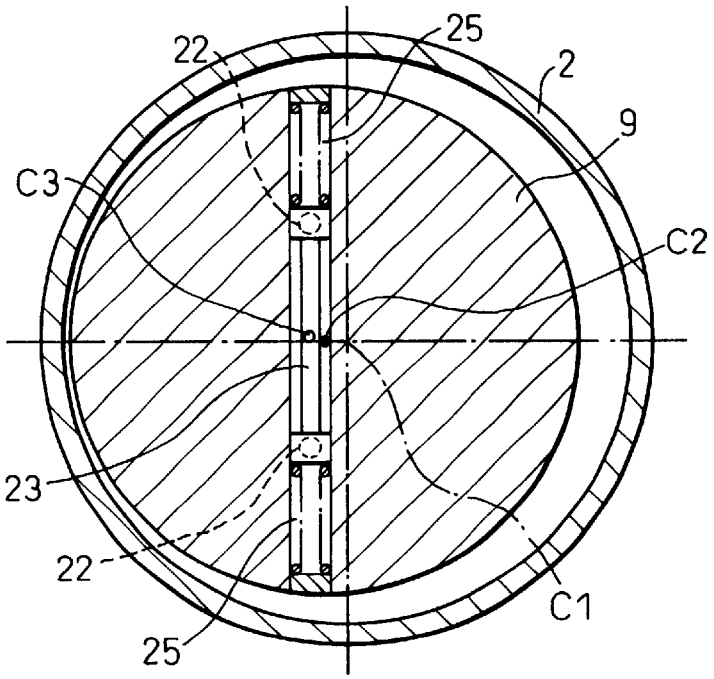
FIG. 9 is a sectional view taken in line A—A in FIG. 1 showing the state in which the movable scroll has orbited by 90° from the state of FIG. 8.
Figure 10:
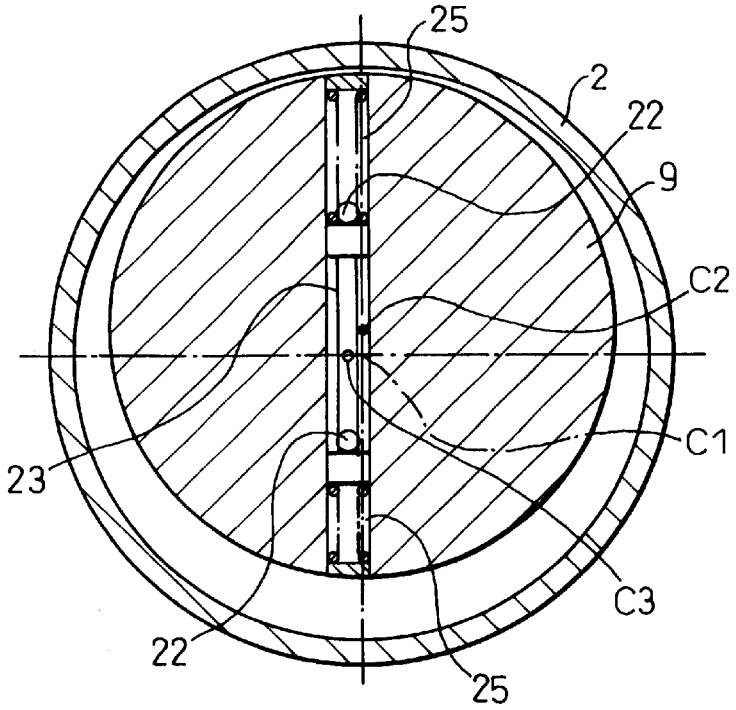
FIG. 10 is a sectional view taken in line A—A in FIG. 1 showing the state in which the movable scroll has orbited by 90° from the state of FIG. 9.
Figure 11:
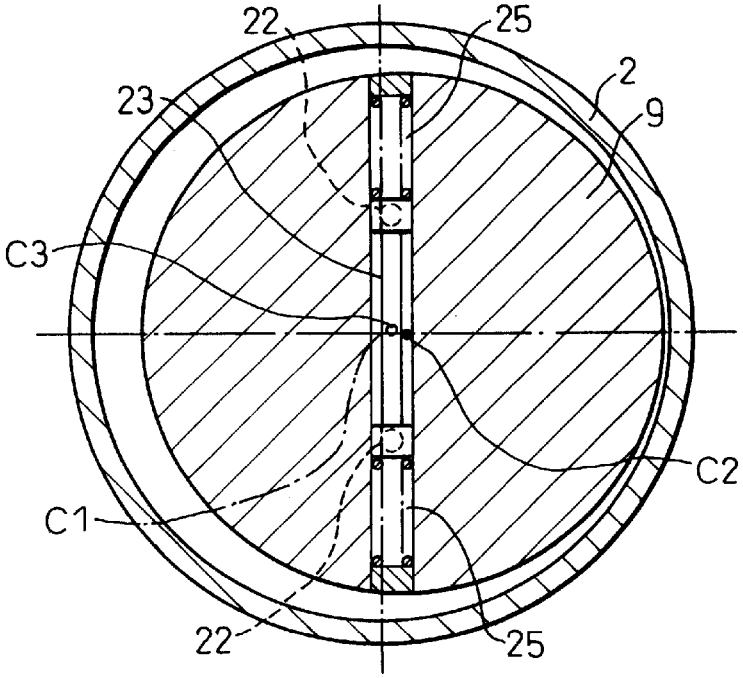
FIG. 11 is a sectional view taken in line A—A in FIG. 1 showing the state in which the movable scroll has orbited by 90° from the state of FIG. 10.

By the way, in the same manner that the rotational speed of the shaft 4 is expressed by the rotational speed of the shaft 4 per unit time, the orbiting speed of the movable scroll 9 can be expressed by the number of orbits the movable scroll 9 has turned in unit time, i.e. the orbital vibration frequency. In the case of scroll-type compressor, the orbital frequency of the movable scroll 9 is equal to the rotational speed of the shaft 4. Therefore, they are both expressed as $\omega$. The amplitude of the movable scroll 9 represents that component of the displacement of the center (center of the crank portion 7) $C_2$ of the movable scroll 9 with respect to the rotational center of the shaft 4 (the orbital center of the movable scroll 9) which occurs in the longitudinal direction of the guide hole 24. In similar fashion, the amplitude of the spool 23 represents that component of the displacement of the longitudinal center (gravitational center) $C_3$ of the spool 23 with respect to the center $C_1$ which occurs in the longitudinal direction of the guide hole 24 (See FIG. 4).

As is clear from equations (1), (2) and FIGS. 3A, 3B, in the case where the rotational speed (the orbital vibration frequency of the movable scroll 9 generating the vibratory force) ω of the shaft 4 is sufficiently smaller than the natural frequency $\omega_0$ of the vibration system including the spool 23 and the coil springs 25 ($\lambda<<1$), the spool 23 vibrates with the phase and amplitude substantially equal to those of the movable scroll 9. In such a case, the spool 23 assumes a substantially stationary state with respect to the movable scroll 9 and therefore the bypass holes 22 are closed.

In the case where the rotational speed (orbital vibration frequency of movable scroll 9) ω of the shaft 4 becomes sufficiently larger than the natural frequency $\omega_0$ ($\lambda>>1$), on the other hand, the spool 23 is vibrated (displaced) with a phase and an amplitude different from those of the movable scroll 9 to a comparatively large degree. As a result, the spool 23 may open the bypass holes 22.

Thus, by selecting an appropriate natural frequency $\omega_0$, the bypass holes 22 may open in the case where the rotational speed ω of the shaft 4 is increased to, or to more than, a predetermined value, while it may remain closed in the case where the rotational speed ω is less than a predetermined value.

By the way, FIGS. 4 to 7 show the operating conditions of the movable scroll 9 and the spool 23 in the case where the rotational speed of the shaft 4, i.e. the orbital vibration frequency ω of the movable scroll 9 is sufficiently smaller than the natural frequency $\omega_0$. As is clear from FIGS. 4 to 7, the movable scroll 9 orbits from the state of FIG. 4 to FIG. 5 to FIG. 6 to FIG. 7 to FIG. 4 with the bypass holes 22 remaining closed, thereby maximizing the discharge capacity of the compressor 100 (this is called the maximum capacity operation).

Also, FIGS. 8 to 11 are diagrams showing the operating conditions of the movable scroll 9 and the spool 23 in the case where the vibration frequency ω is sufficiently larger than the natural frequency $\omega_0$. As is clear from FIGS. 8 to 11, with the progress of the orbiting of the movable scroll 9 from FIGS. 8 to 11, the bypass holes 22 alternate between open and closed states. As a result, the amount of the refrigerant sucked into the working chamber V is equal to the amount sucked from the time point when the bypass holes 22 are closed to the time point when the volume of the working chamber V begins to decrease. Thus, the discharge capacity of the compressor 100 is reduced (this is called the variable capacity operation).

Figure 12:
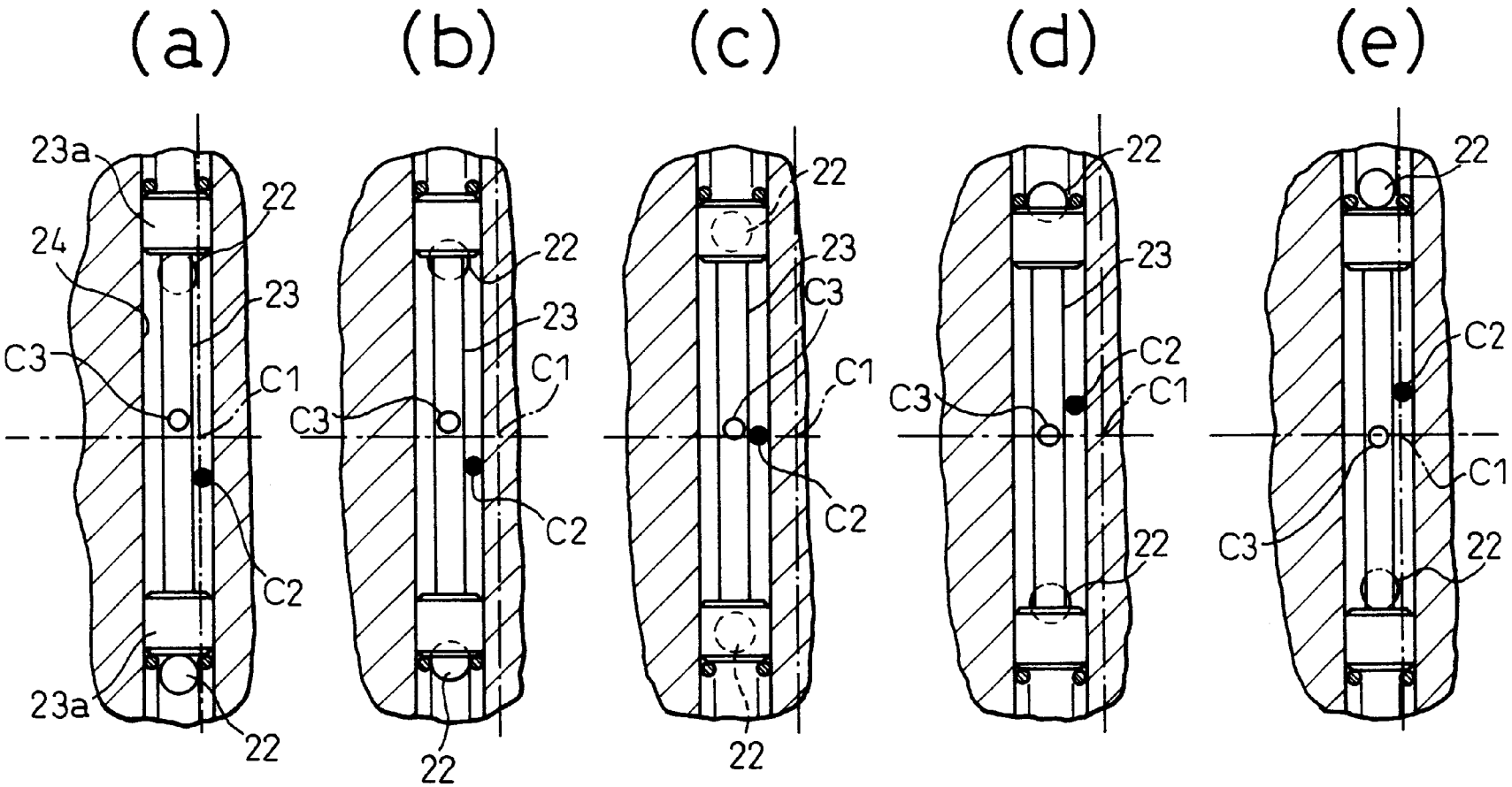
FIGS. 12(*a*)–(*e*) explain the operation of the spool.

FIG. 12 is an enlarged view of the portions of the spool 23 and the bypass holes 22. The spool 23 is vibrated (displaced) with respect to the bypass holes 22 (movable scroll 9) in the order of (a) to (b) to (c) to (d) to (e) to (a).

Figure 13:
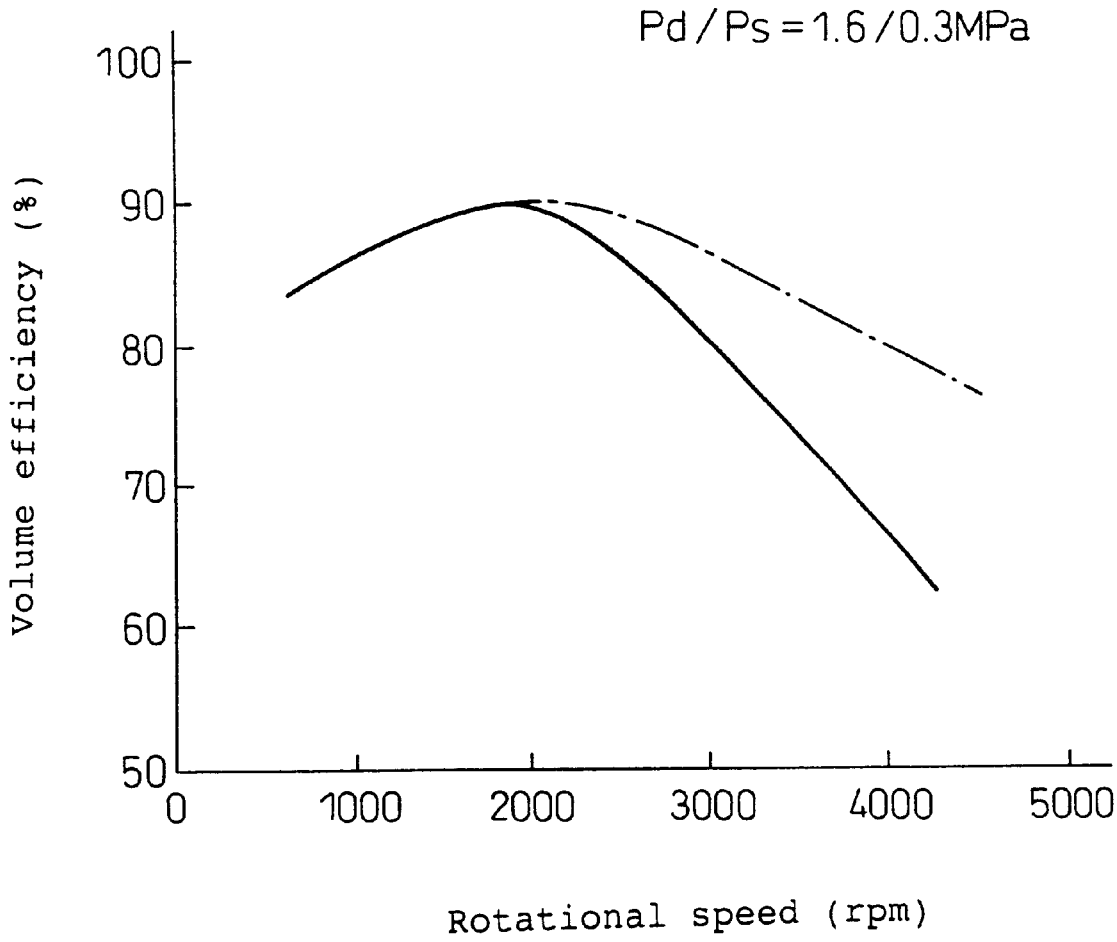
FIG. 13 is a graph showing the relation between the volume efficiency and the rotational speed of a variable capacity-type scroll compressor according to the first embodiment.

Also, the solid line in FIG. 13 is a graph showing a test result indicating the volume efficiency of the compressor according to this embodiment when the spring constant k of the coil spring 25 and the mass m of the spool 23 are selected so that the rotational speed ω of the shaft 4 coincides with the natural frequency $\omega_0$ when the former reaches 2000 rpm. As is apparent from the graph, when the rotational speed ω of the shaft 4 reaches 4000 rpm, the volume efficiency (discharge capacity/suction capacity) of the compressor 100 is seen to have decreased by about 15% as compared with the case where the maximum capacity operation is continued (one-dot chain) with the bypass holes 22 closed.

As described above, with the compressor 100 according to the first embodiment, the discharge capacity can be controlled by opening/closing the bypass holes 22 using a simple means in which the natural frequency $\omega_0$ of the vibration system including the spool 23 and the coil springs 25 is set to a predetermined value and the spool 23 is forcibly vibrated under the vibratory force received from the movable scroll 9 through the coil springs 25. Thus, the manufacturing cost of the compressor 100 is reduced and the reliability (durability) thereof is improved.

Figure 14:
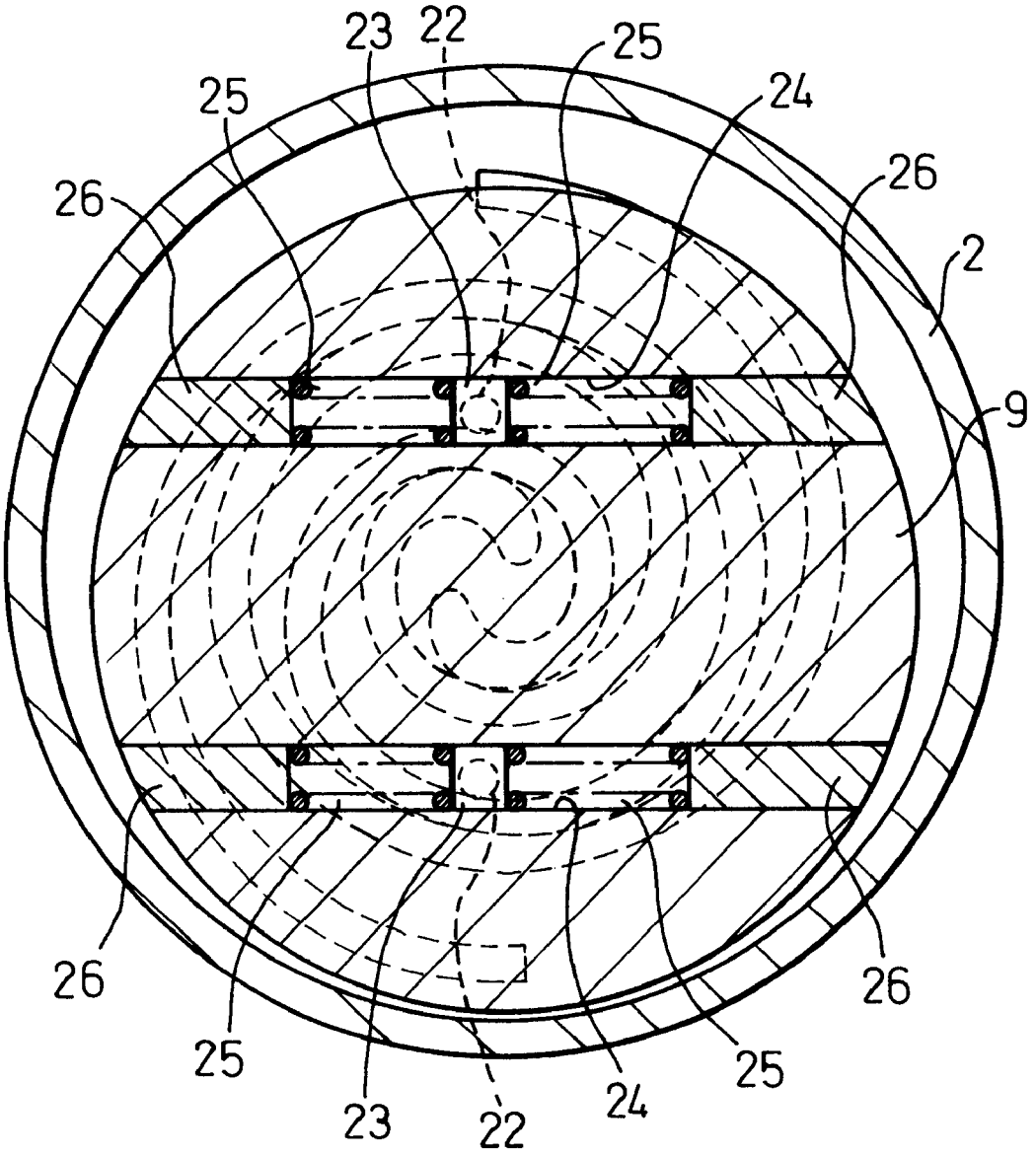
FIG. 14 is a sectional view corresponding to FIG. 2 of a variable capacity-type scroll compressor according to a modification of the first embodiment.

By the way, the first embodiment is so configured that the two bypass holes 22 are opened and closed by one spool 23. As shown in FIG. 14, however, a separate guide hole 24 and the spool 23 may alternatively be provided for each bypass hole 22.

Figure 15:
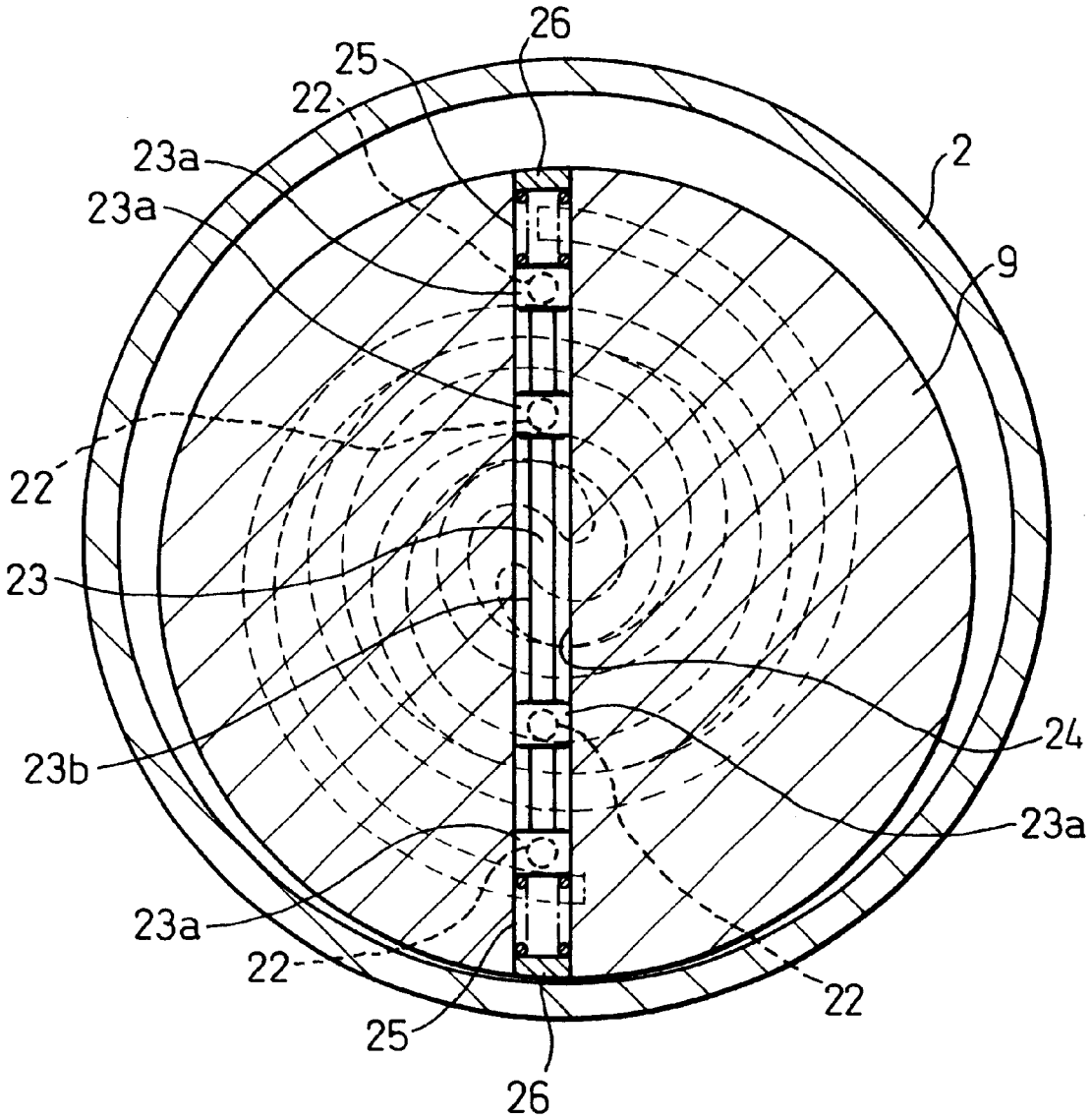
FIG. 15 is a sectional view corresponding to FIG. 2 of a variable capacity-type scroll compressor according to a modification of the first embodiment.

Further, as shown in FIG. 15, two or more (four in FIG. 15) bypass holes 22 may be provided for each guide hole 24.

Also, according to the first embodiment, the spool 23 is so set that the bypass holes 22 are closed when the shaft 4 (and the movable scroll 9) is stationary. Conversely, the position of the bypass holes 22 and the spool 23, etc., may alternatively be set in such a manner that the bypass holes 22 open when the compressor 100 is deactivated.

In such a case, the bypass holes 22 are closed when the rotational speed ω of the shaft 4 becomes sufficiently high as compared with the natural frequency $\omega_0$. Therefore, in the application of the present invention to the vehicle climate system or the like, the shock at the time of starting the compressor 100 (at the time of connecting the solenoid clutch) can be alleviated.

(Second embodiment)

According to the first embodiment, the discharge capacity of the compressor 100 is changed in two stages, i.e. before and after the orbital vibration frequency of the movable scroll 9, i.e. the rotational speed ω of the shaft 4 reaches the natural frequency $\omega_0$. The second embodiment, on the other hand, is so configured that the discharge capacity of the compressor 100 can be changed in three stages.

Figure 16:
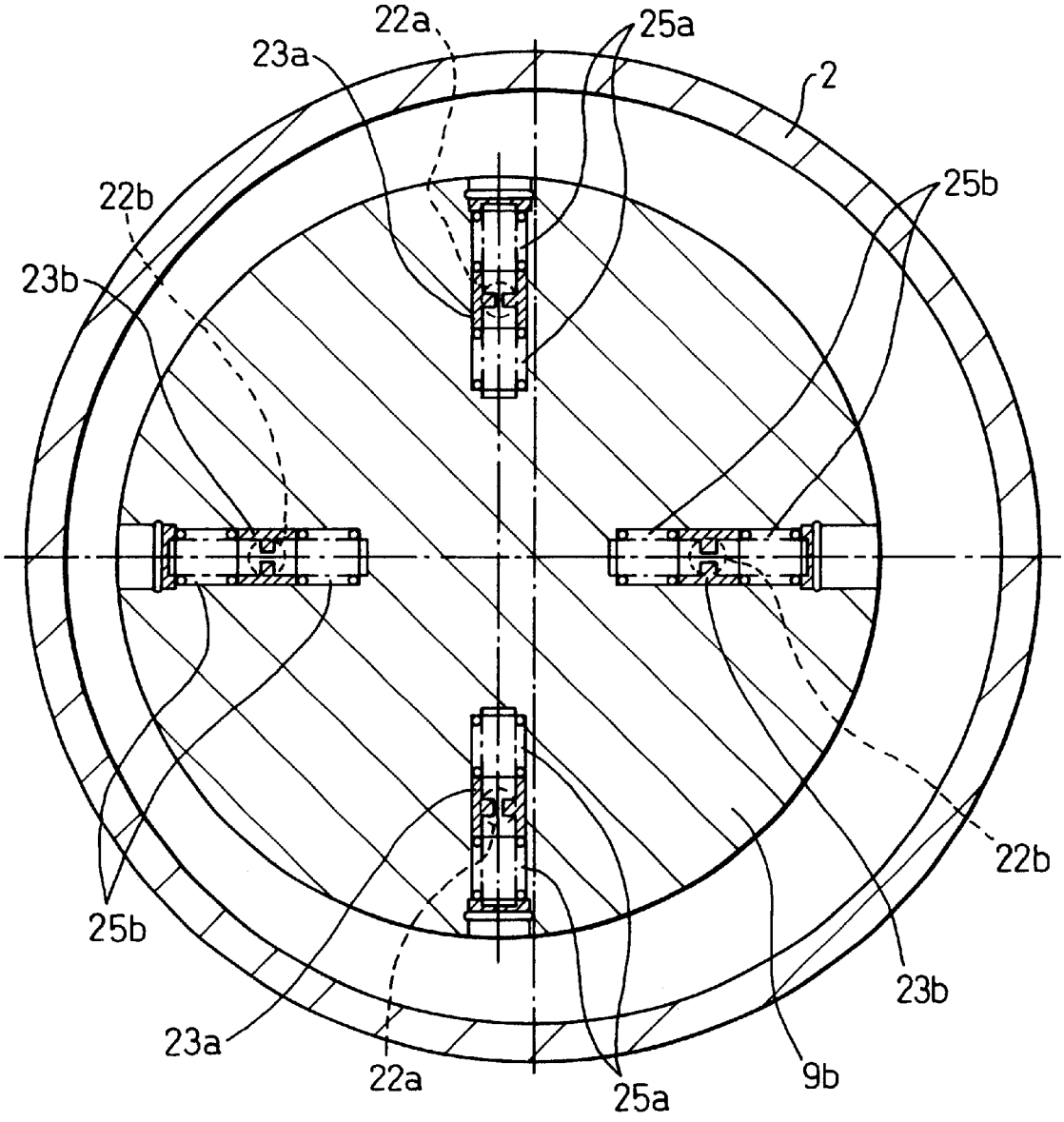
FIG. 16 is a sectional view taken in line C—C in FIG. 17 showing the operating condition $\omega<\omega_{01}<\omega_{02}$ of a variable capacity-type scroll compressor according to a second embodiment.

Specifically, as shown in FIG. 16, the spool 23 and the coil spring 25 are provided in a plurality of sets, so that the spools 23*a*, 23*b* and the coil springs 25*a*, 25*b* are arranged vertically and horizontally, while at the same differentiating the natural frequencies $\omega_{01}$, $\omega_{02}$ in vertical and horizontal directions as determined by the spools 23*a*, 23*b* and the spring constants of a plurality of the coil springs 25*a*, 25*b* exerting the elasticity on the spools 23*a*, 23*b*.

Figure 17:
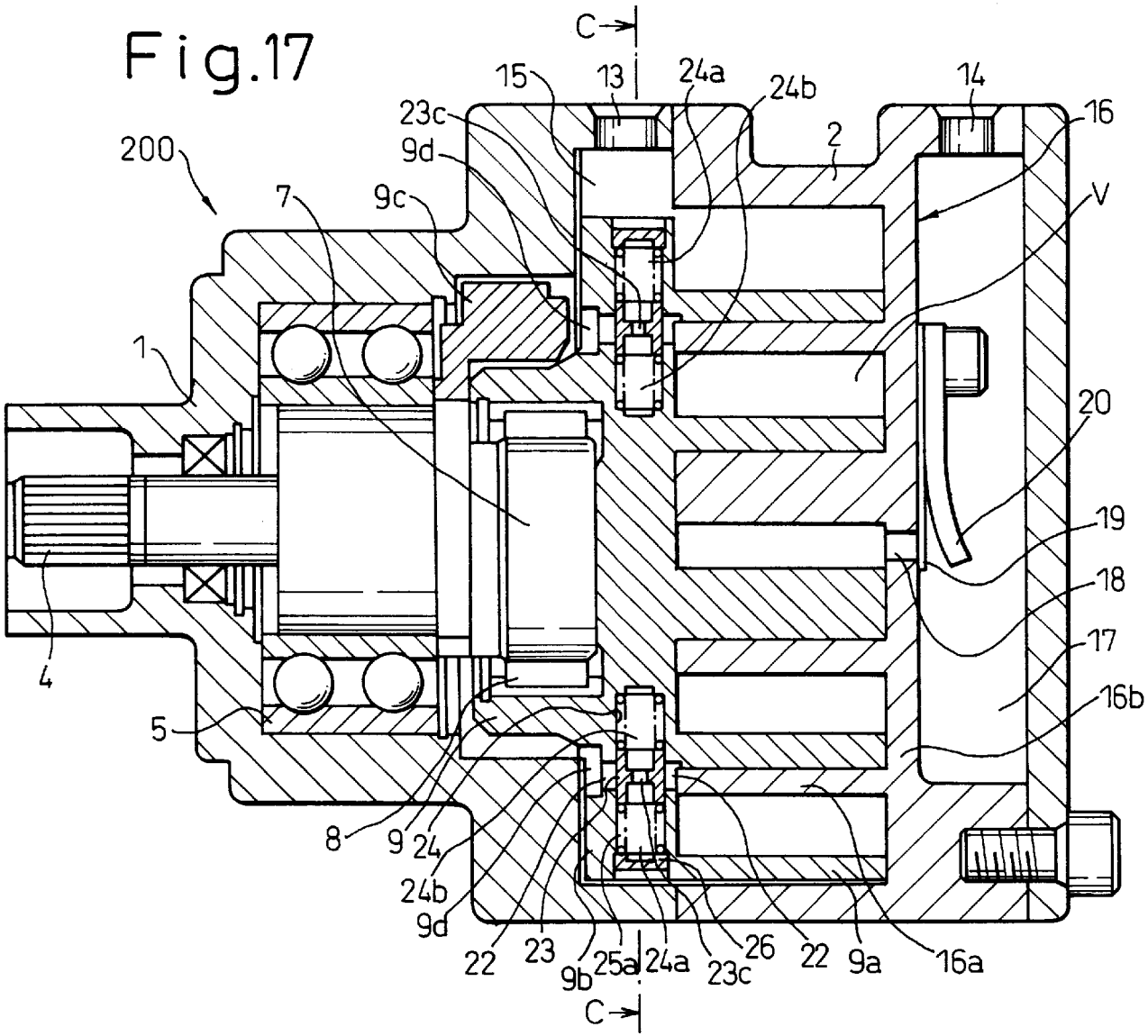
FIG. 17 is a longitudinal sectional view (sectional view taken in line D—D in FIG. 20) of a variable capacity-type scroll compressor according to the second embodiment.
Figure 18:
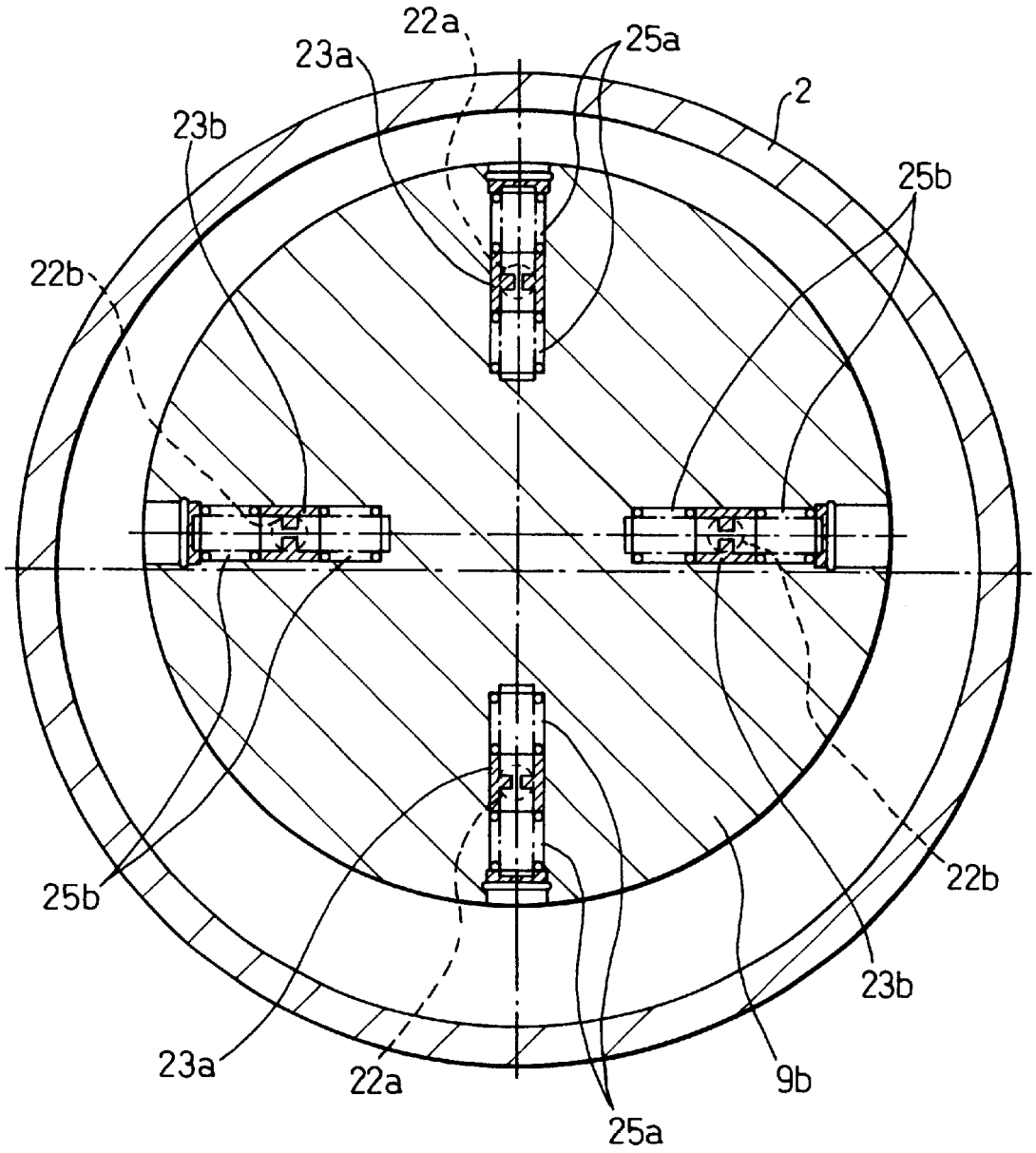
FIG. 18 is a sectional view taken in line C—C in FIG. 17 showing the state in which the movable scroll has orbited by 90° from the state of FIG. 16
Figure 19:
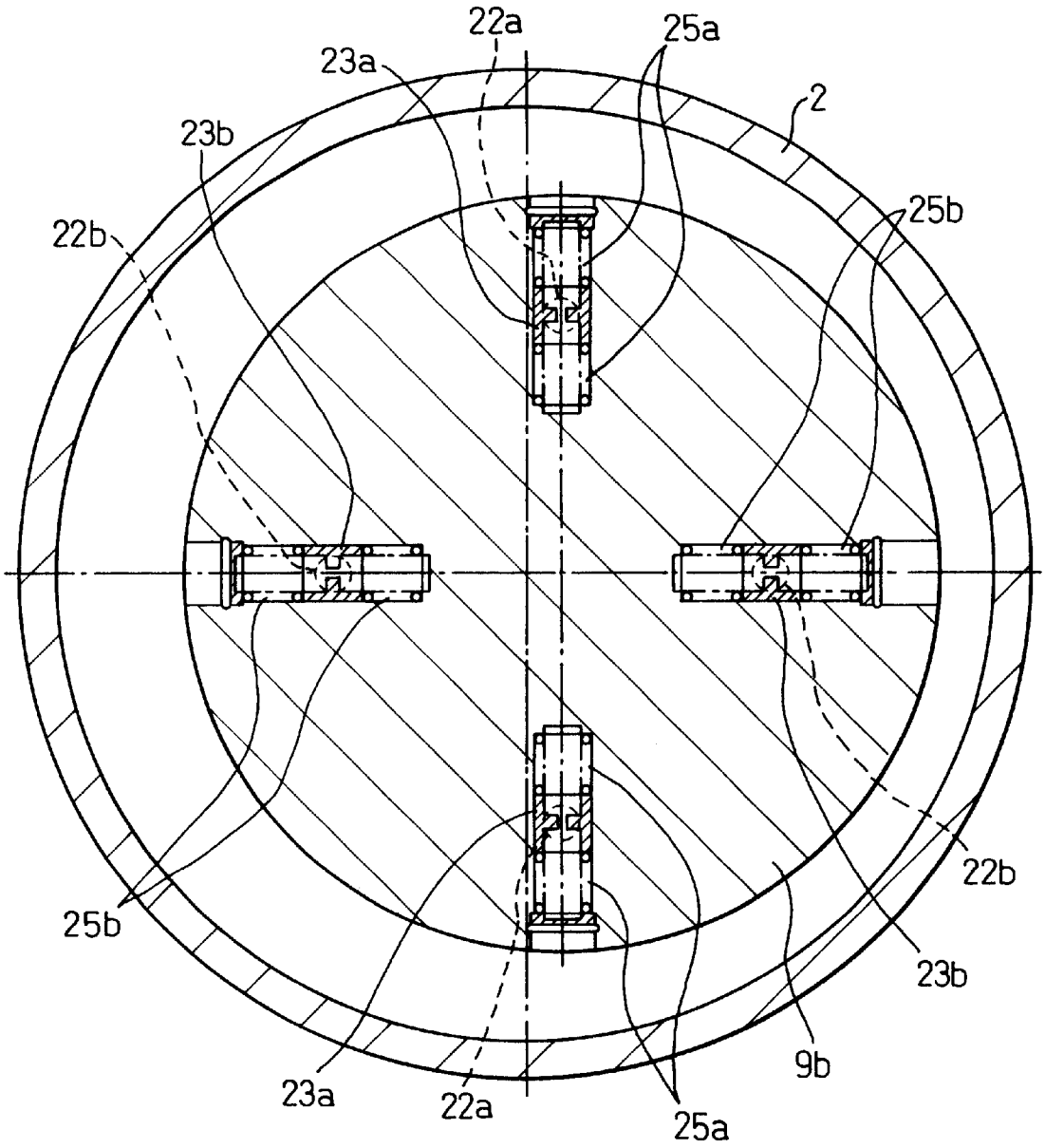
FIG. 19 is a sectional view taken in line C—C in FIG. 17 showing the state in which the movable scroll has orbited by 90° from the state of FIG. 18.
Figure 20:
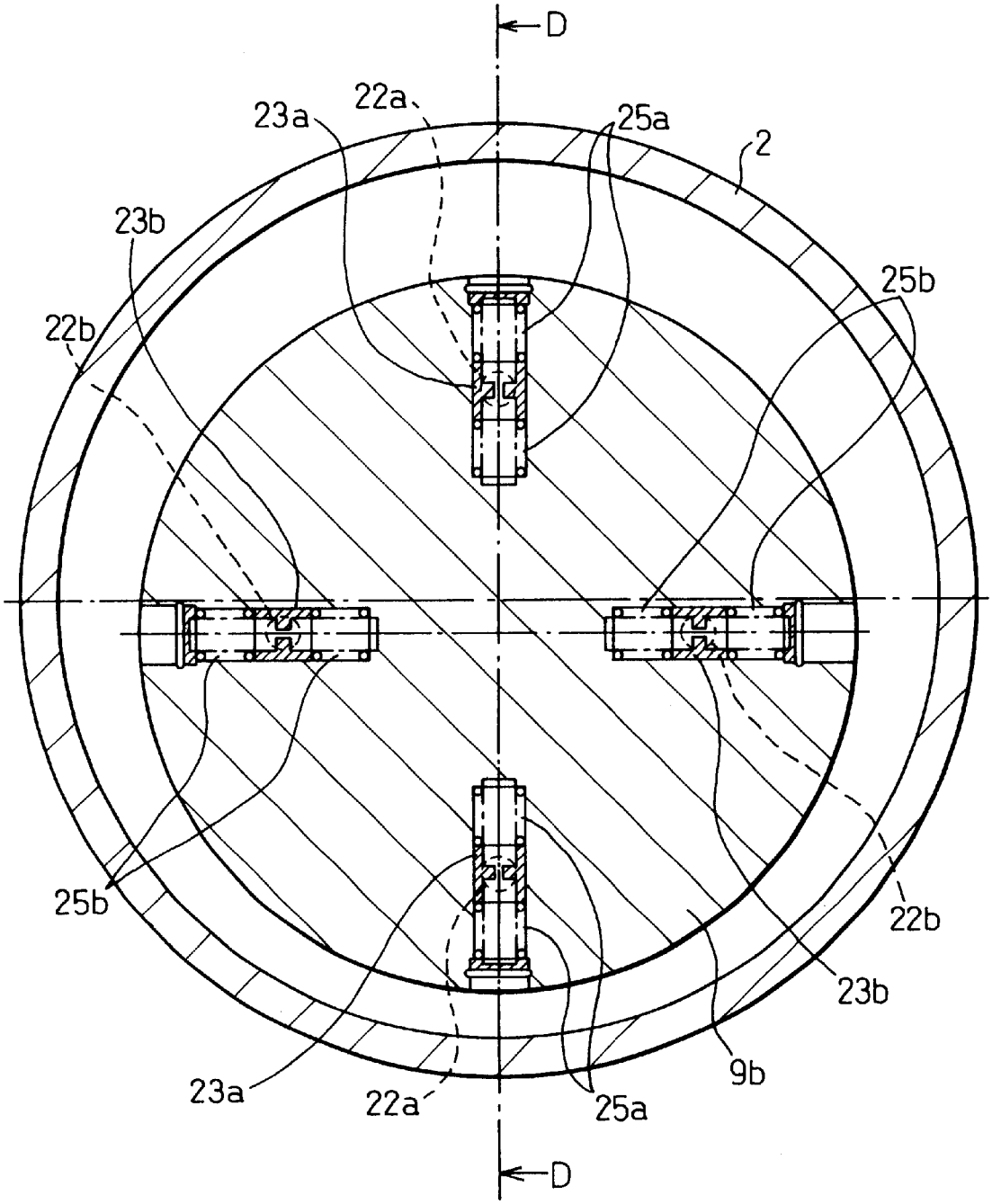
FIG. 20 is a sectional view taken in line C—C in FIG. 17 showing the state in which the movable scroll has orbited by 90° from the state of FIG. 19.
Figure 21:
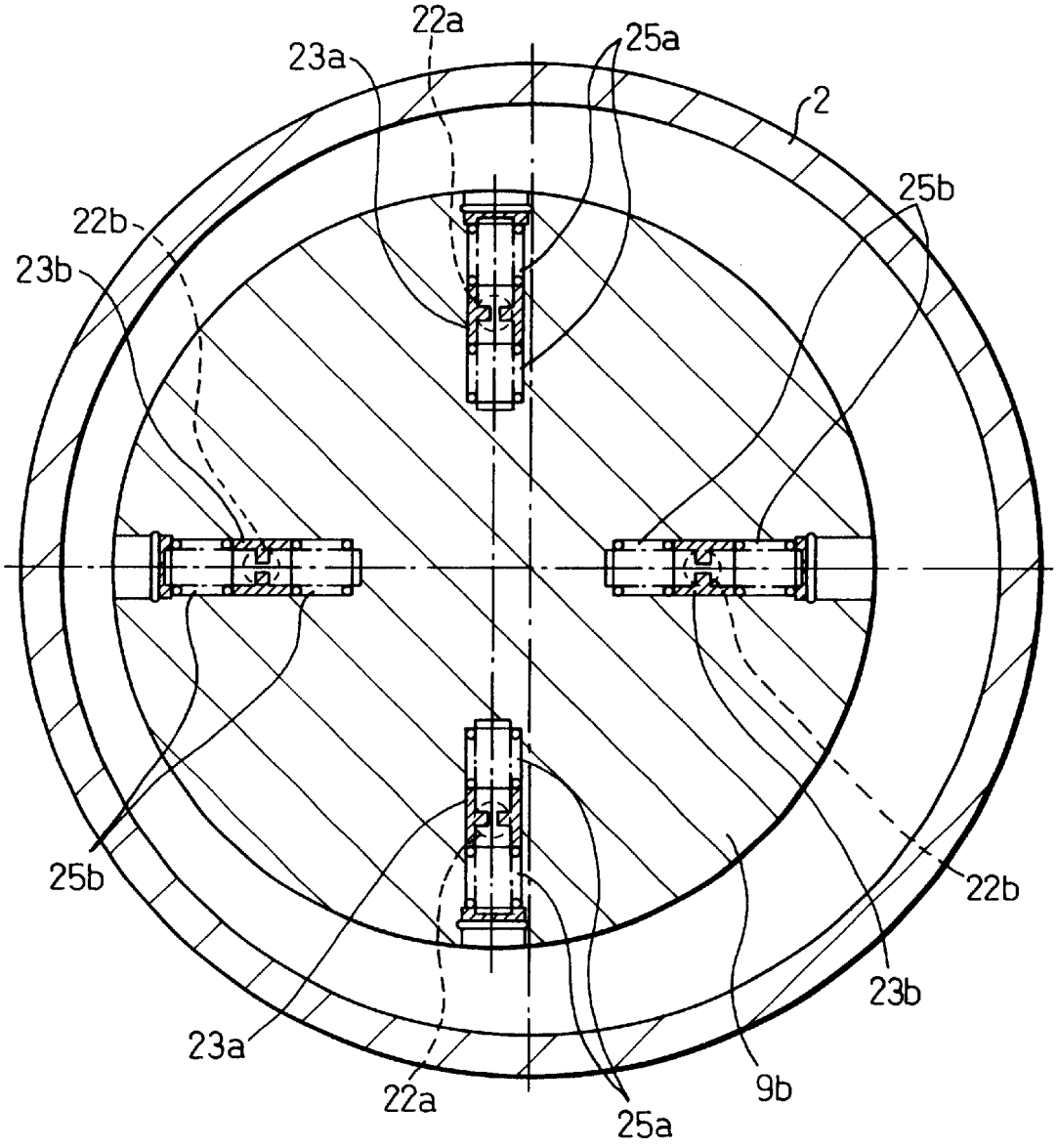
FIG. 21 is a sectional view taken in line C—C in FIG. 17 showing the operating condition $\omega_{01}<\omega<\omega_{02}$ of a variable capacity-type scroll compressor according to the second embodiment.
Figure 22:
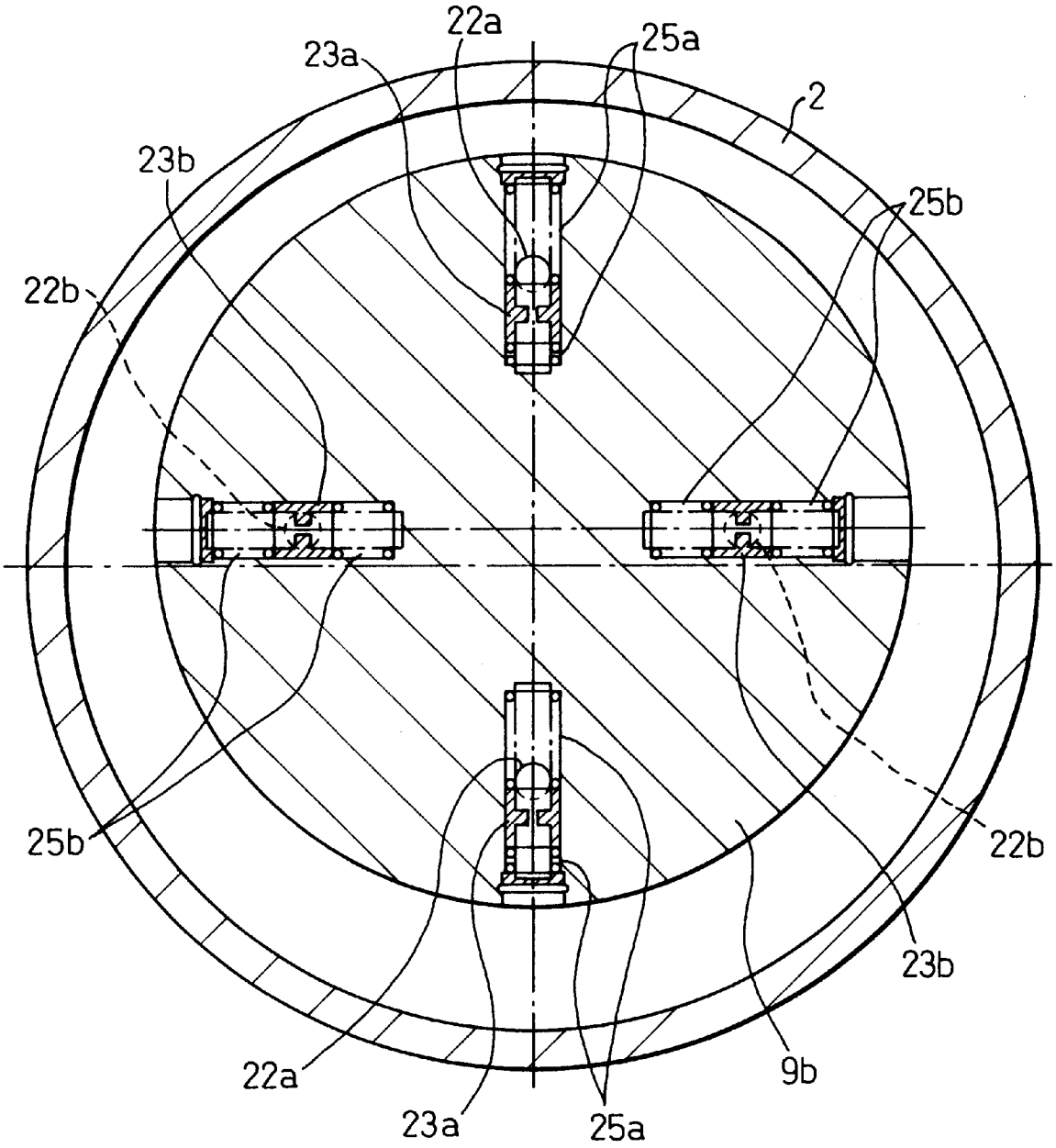
FIG. 22 is a sectional view taken in line C—C in FIG. 17 showing the state in which the movable scroll has orbited by 90° from the state of FIG. 21.
Figure 23:
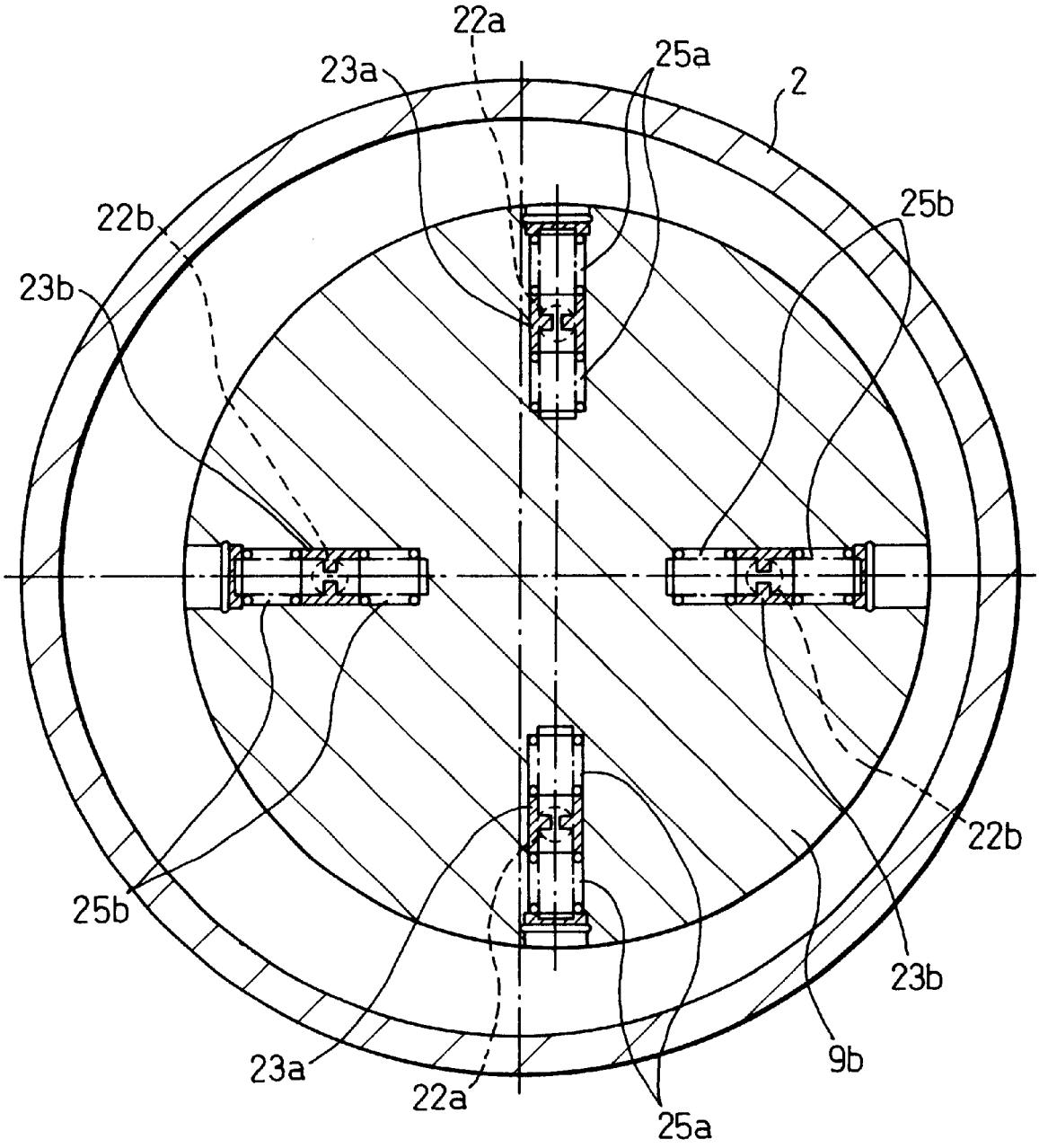
FIG. 23 is a sectional view taken in line C—C in FIG. 17 showing the state in which the movable scroll has orbited by 90° from the state of FIG. 22.
Figure 24:
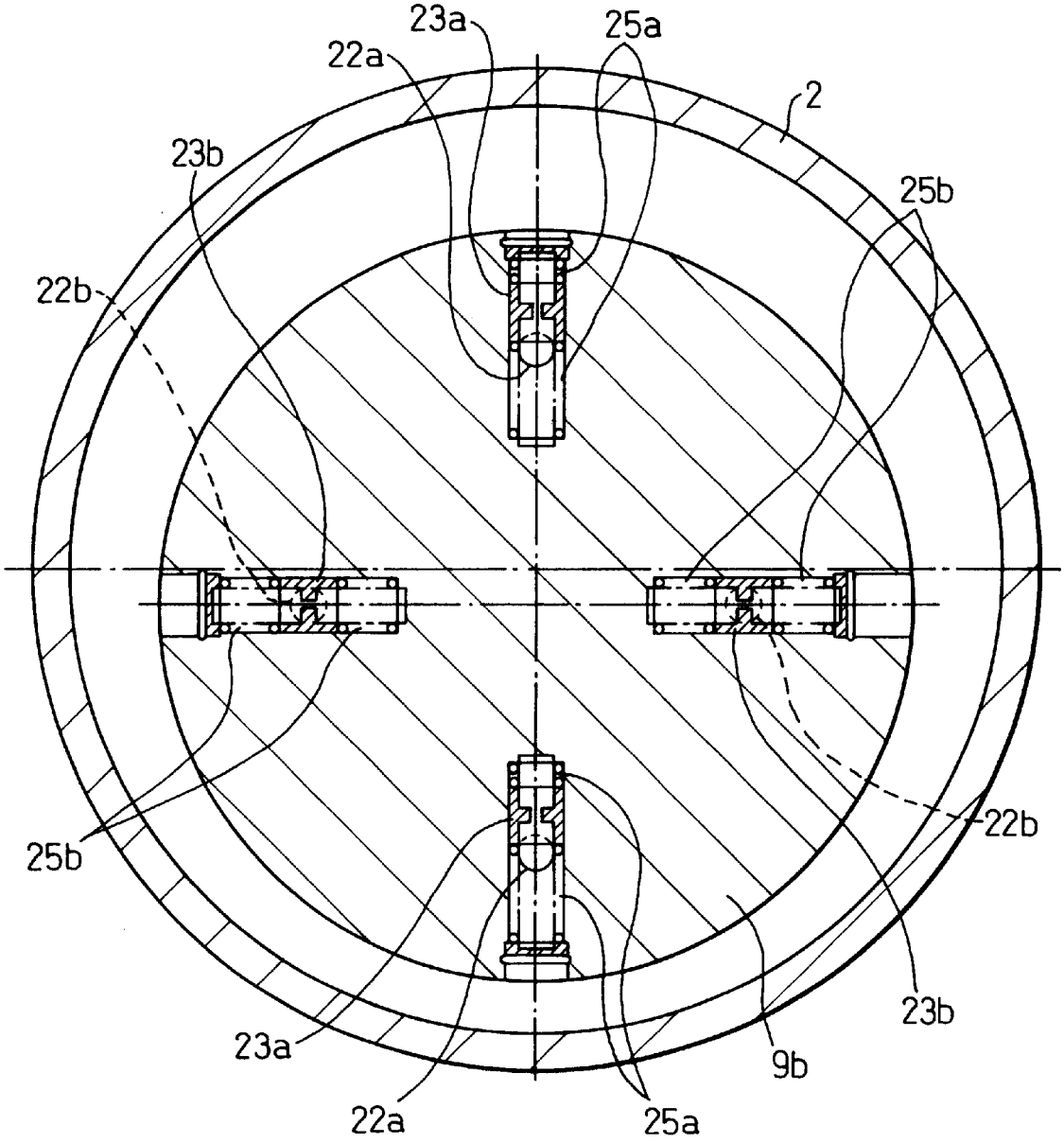
FIG. 24 is a sectional view taken in line C—C in FIG. 17 showing the state in which the movable scroll has orbited by 90° from the state of FIG. 23.
Figure 25:
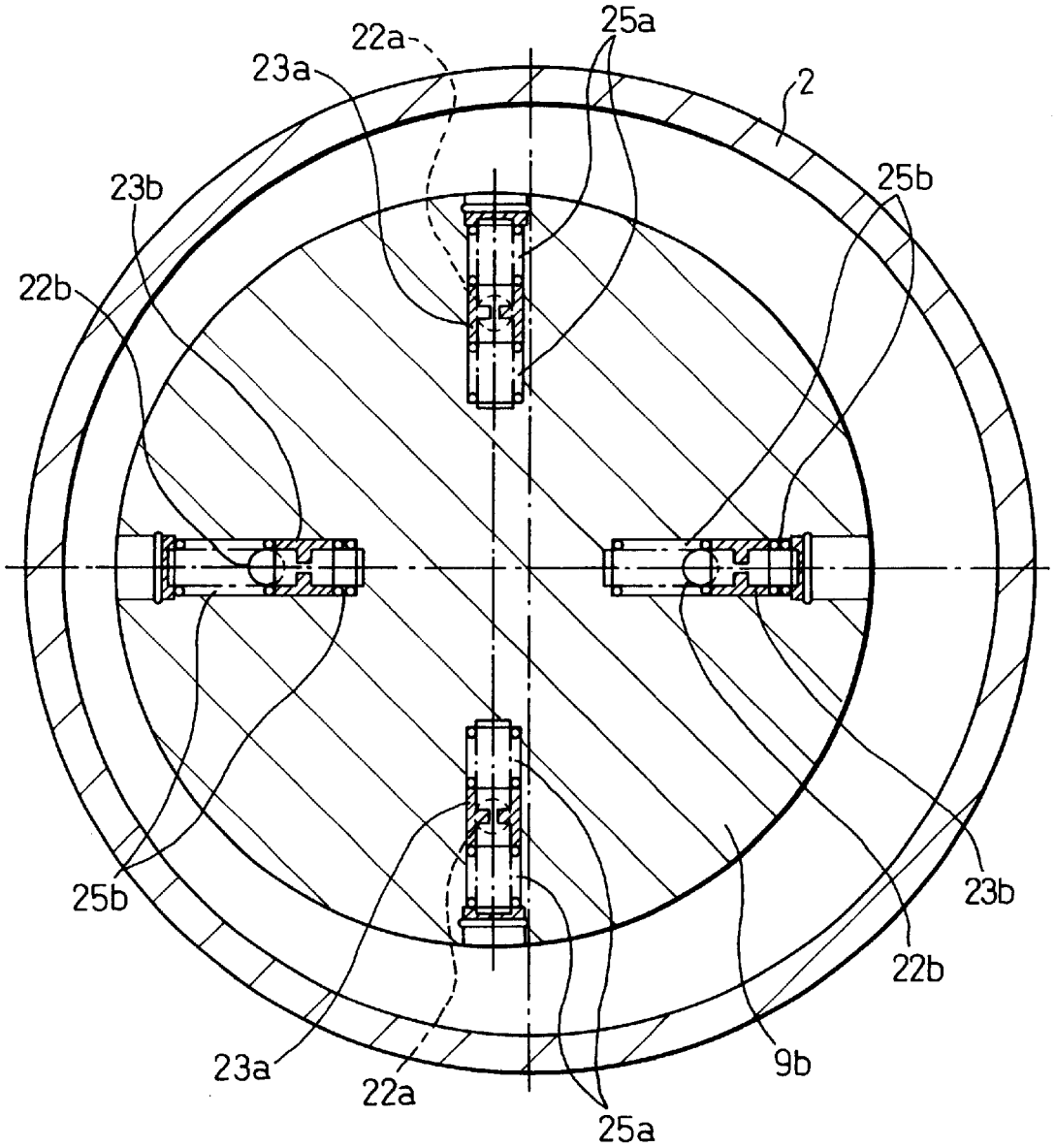
FIG. 25 is a sectional view taken in line C—C in FIG. 17 showing the operating condition $\omega_{01}<\omega_{02}<\omega$ of a variable capacity-type scroll compressor according to the second embodiment.
Figure 26:
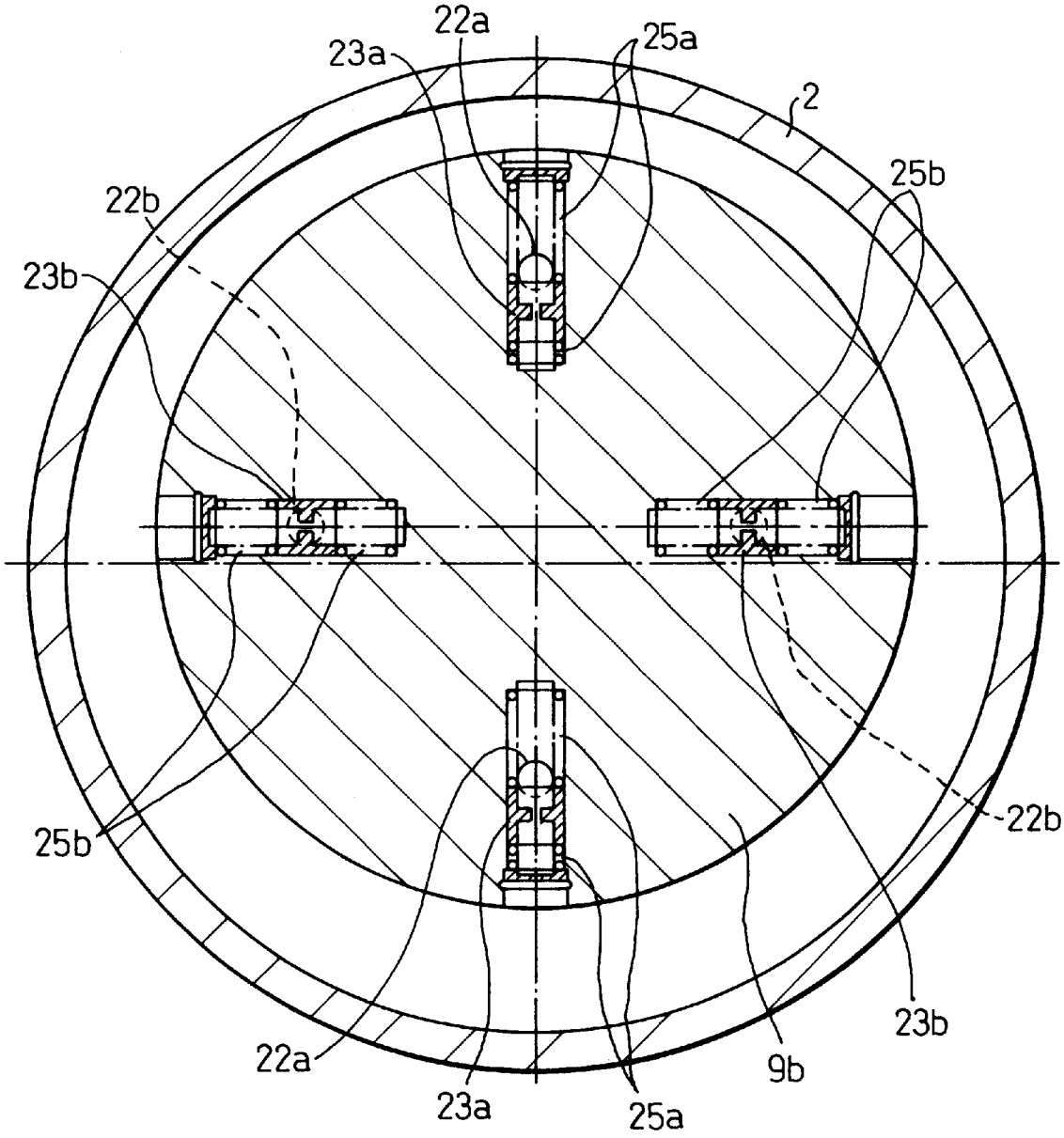
FIG. 26 is a sectional view taken in line C—C in FIG. 17 showing the state in which the movable scroll has orbited by 90° from the state of FIG. 25.
Figure 27:
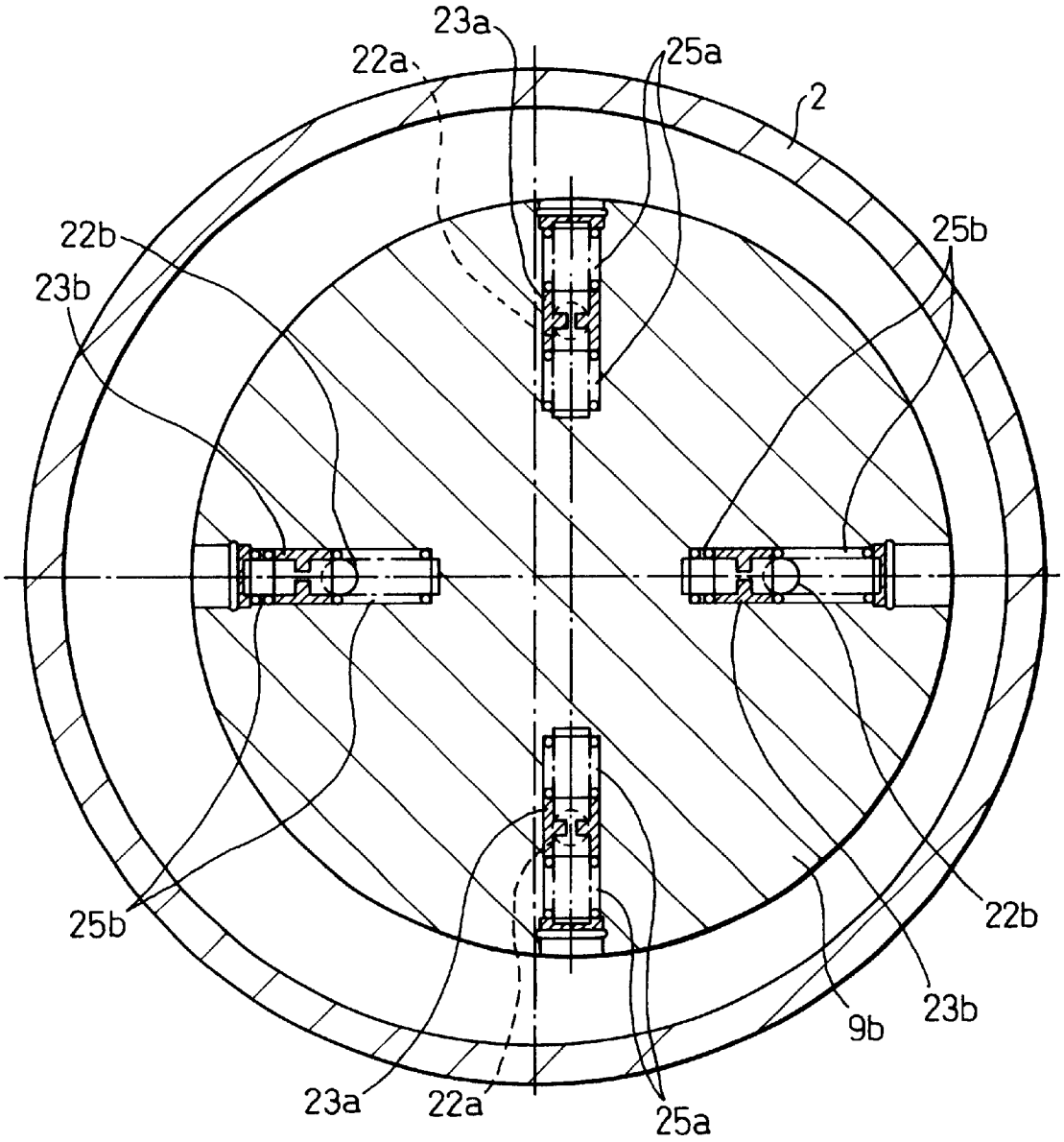
FIG. 27 is a sectional view taken in line C—C in FIG. 17 showing the state in which the movable scroll has orbited by 90° from the state of FIG. 26.
Figure 28:
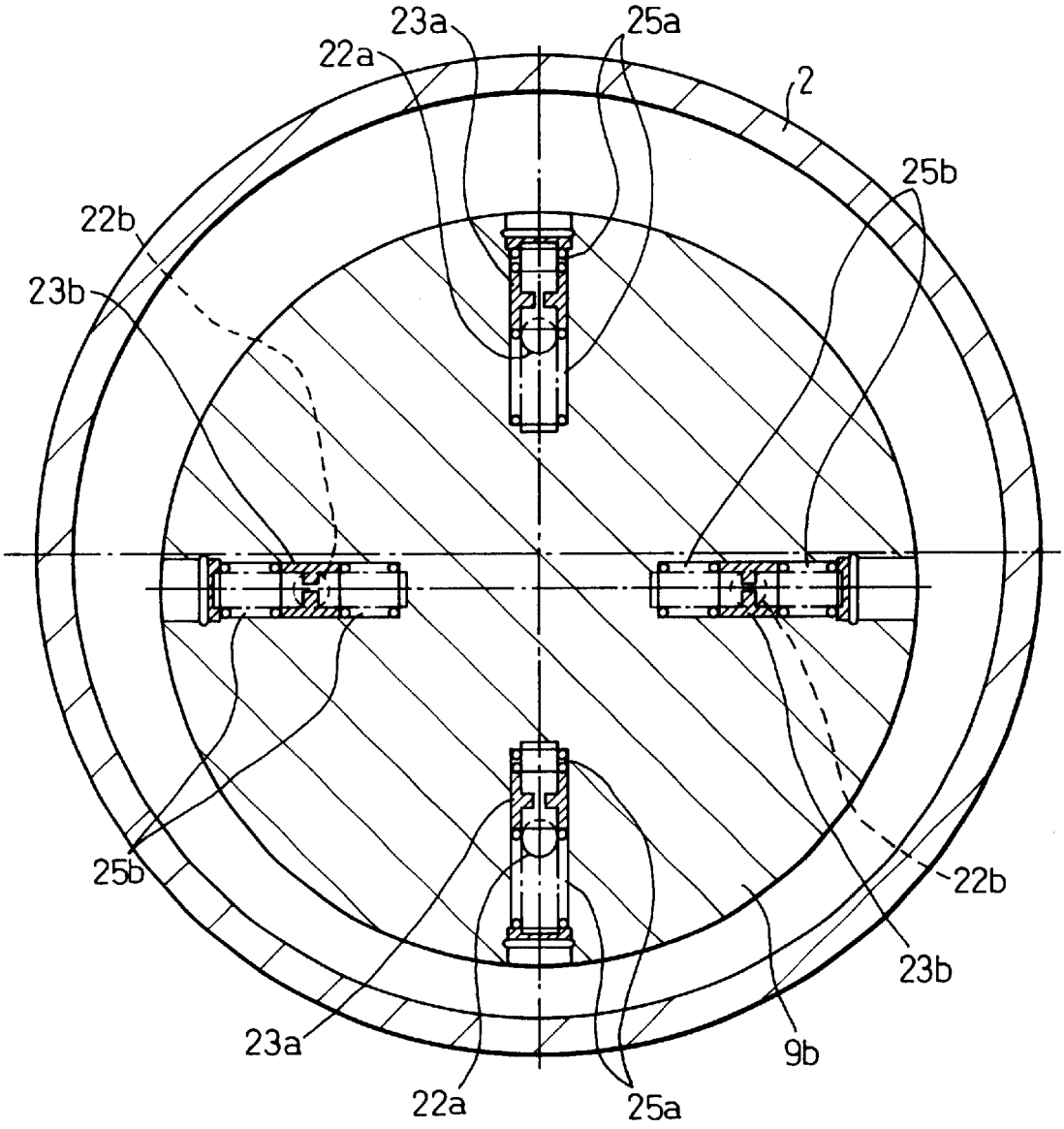
FIG. 28 is a sectional view taken in line C—C in FIG. 17 showing the state in which the movable scroll has orbited by 90° from the state of FIG. 27.

By the way, FIG. 16 shows one state taken in line C—C of the compressor according to the second embodiment of which a longitudinal sectional view is shown in FIG. 17. The other states are shown in FIGS. 18 to 20. According to the second embodiment, a pair of first and second bypass holes 22*a*, 22*b* are formed vertically and horizontally, as viewed in FIG. 16, of the end plate portion 9*b* of the movable scroll 9. The openings of the bypass holes 22*a*, 22*b* nearer to the front housing 1 are formed with a recess 9*d* depressed toward the fixed scroll 16. Also, the spools 23*a* and 23*b* inserted into each pair of guide holes in vertical and horizontal directions are formed with a communication hole 23*c* for establishing communication between spacings 24*a*, 24*b* formed on the sides thereof.

According to the second embodiment, the mass of the spools 23*a*, 23*b* and the spring constant of the coil springs 25*a*, 25*b* are set in such a manner that the first natural frequency $\omega_{01}$ determined by the spools 23*a* and the coil springs 25*a* is smaller than the second natural frequency $\omega_{02}$ determined by the spools 23*b* and the coil springs 25*b*.

For this reason, in the case where the rotational speed (i.e. the orbital vibration frequency of the movable scroll 9) $\omega$ of the shaft 4 is sufficiently small as compared with the first natural frequency $\omega_{01}$ and the second natural frequency $\omega_{02}$ ($\omega<<\omega_{01}<\omega_{02}$), the first and second bypass holes 22*a*, 22*b* are both closed.

In the case where the rotational speed $\omega$ of the shaft 4 is larger than the first natural frequency $\omega_{01}$ and smaller than the second natural frequency $\omega_{02}$ ($\omega_{01}<\omega<\omega_{02}$), the first bypass holes 22*a* open while the second bypass holes 22*b* are closed.

Also, in the case where the rotational speed $\omega$ of the shaft 4 becomes large as compared with the first natural frequency $\omega_{01}$ and the second natural frequency $\omega_{02}$ ($\omega_{01}<\omega_{02}<\omega$), the first bypass holes 22*a* and the second bypass holes 22*b* are both opened.

By the way, FIGS. 16 to 20 are diagrams showing the operating conditions (maximum capacity operating conditions) of the movable scroll 9 and the spools 23*a*, 23*b* in the case where the vibration frequency $\omega$ is sufficiently smaller than the two natural frequencies $\omega_{01}$ and $\omega_{02}$. As is clear from FIGS. 16 to 20, the movable scroll 9 orbits from $\omega$ the states shown of FIG. 16 to FIG. 18 to FIG. 19 to FIG. 20 to FIG. 16 in that order with the two bypass holes 22*a*, 22*b* closed.

Also, FIGS. 21 to 24 are diagrams showing the operating conditions (variable capacity operating conditions) of the movable scroll 9 and the spools 23*a*, 23*b* in the case where the vibration frequency $\omega$ is larger than the first natural frequency $\omega_{01}$ and smaller than the second natural frequency $\omega_{02}$. As is clear from FIGS. 21 to 24, with the progress of the orbiting of the scroll roll 9 from the states of FIG. 21 to FIG. 24, the first bypass holes 22*a* alternate between open and closed states. As a consequence, the amount of the refrigerant sucked into the working chamber V constitutes the amount sucked during the period from the time point when the first bypass holes 22*a* are closed to the time point when the volume of the working chamber V begins to decrease. Thus the discharge capacity of the compressor 200 is reduced (changed).

Also, FIGS. 25 to 28 are diagrams showing the operating conditions (variable capacity operating conditions) of the movable scroll 9 and the spools 23*a*, 23*b* in the case where the vibration frequency $\omega$ is sufficiently larger than both the natural frequencies $\omega_{01}$ and $\omega_{02}$. As is clear from FIGS. 25 to 28, with the progress of the orbiting of the scroll roll 9 from the states of FIG. 25 to FIG. 28, the two bypass holes 22*a*, 22*b* alternate between open and closed states. As a consequence, the amount of the refrigerant sucked into the working chamber V constitutes the amount sucked during the period from the time point when the two bypass holes 22*a*, 22*b* are closed to the time point when the volume of the working chamber V begins to decrease. Thus the discharge capacity of the compressor 200 is reduced (changed).

Figure 29:
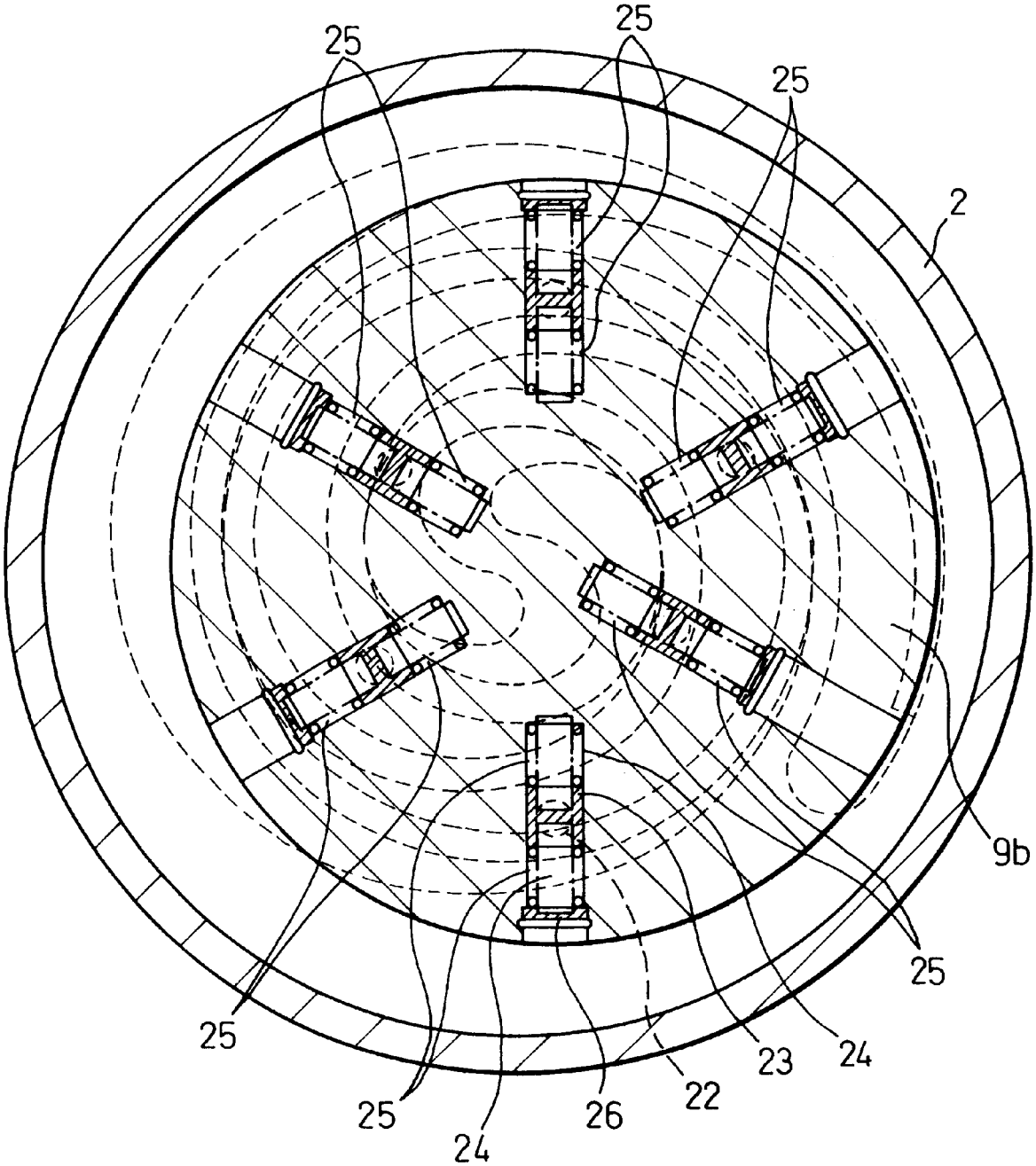
FIG. 29 is a sectional view take in line C—C in FIG. 17 showing the operating condition of a variable capacity-type scroll compressor according to a modification of the second embodiment.

By the way, the second embodiment is not limited to the structures shown in FIGS. 16 and 17 but, as shown in the modification of FIG. 29, the number of the spools 23 and the coil springs 25 can be increased further to provide three or more different natural frequencies $\omega_0$. By doing so, the discharge capacity of the compressor 200 can be controlled in four or more stages.

(Third Embodiment)

Figure 30:
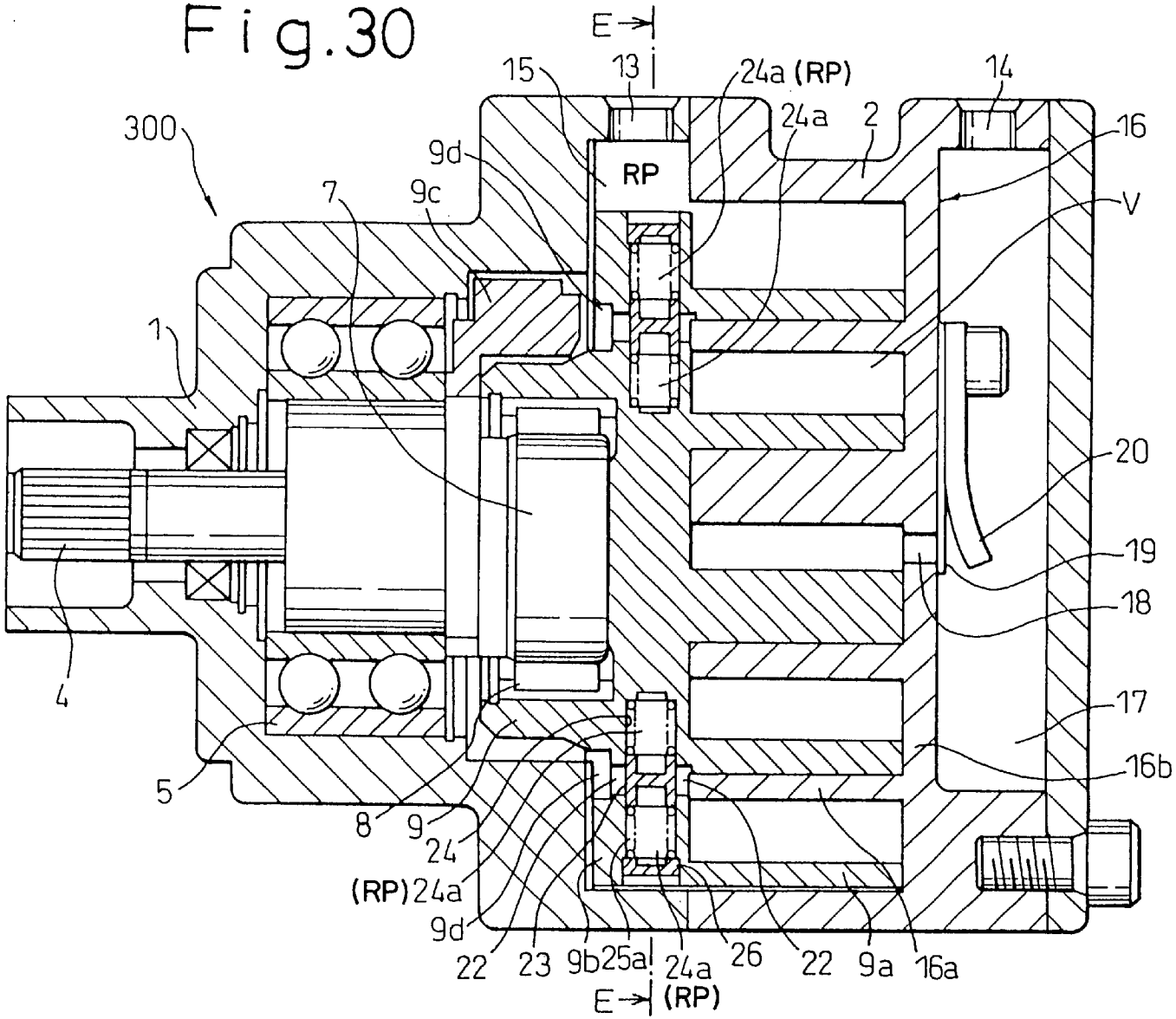
FIG. 30 is a longitudinal sectional view (sectional view taken in line F—F in FIG. 36) of a variable capacity-type scroll compressor according to a third embodiment.
Figure 31:
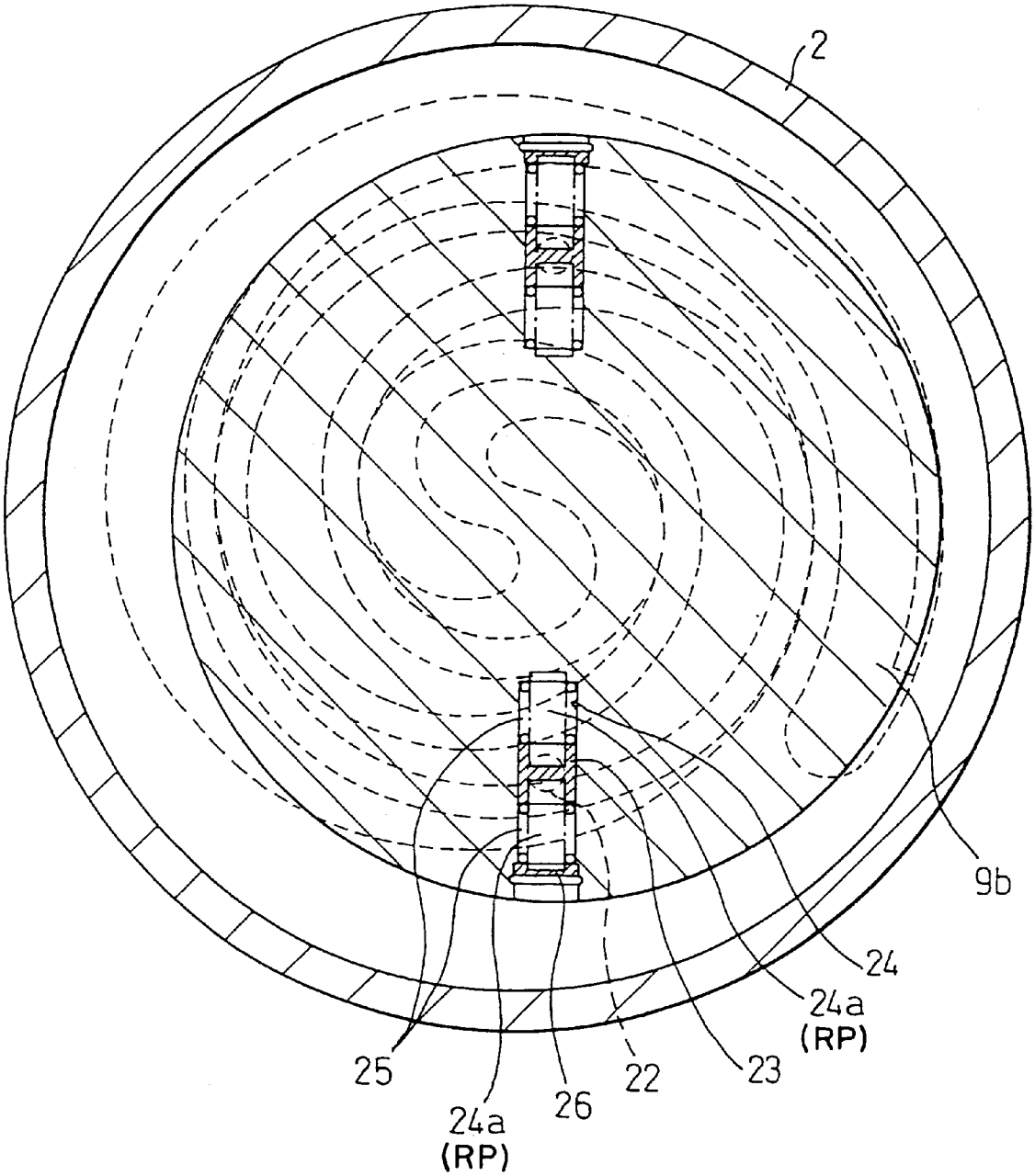
FIG. 31 is a sectional view taken in line E—E in FIG. 30.

In each of the embodiments described above, the elastic member is configured only of the coil springs 25. In the compressor 300 according to the third embodiment, in contrast, as shown in FIGS. 30 and 31, the refrigerant pressure RP of the suction chamber 15 introduced into the spacing 24*a* (the spacing in which the coil springs 25*a* are arranged in the third embodiment) formed by the spool 23 and the guide hole 24 with the bypass holes 22 closed is exerted on the spool 23 thereby to constitute an elastic member (hereinafter referred to as the fluid spring RP).

As a result, the mean elastic constant k of the elastic member according to the third embodiment, as indicated by equation (3) below, increases substantially in proportion to the internal pressure of the suction chamber 15 (generally, on the suction port 13 side). With the increase in the pressure of the suction chamber 15, therefore, the natural frequency $\omega_0$ determined by the spool 23 and the fluid spring RP increases.

$$k=(P_2-P_s)\cdot A/X \tag{3}$$

$P_2$: Mean pressure in spacing 24*a*

$P_2=P_s\cdot(V_1/V_a)^k$ $P_s$=Internal pressure of suction chamber 15 k: Polytropic exponent (1.1 to 1.4)

$V_1$: Volume of spacing 24*a* when spool 23 is stationary (when bypass holes 22 are closed)

$V_2$: Volume of spacing 24*a* when spool 23 has moved a distance X

X: Mean distance covered (displacement) of spool 23

A: Sectional area of guide hole 24 (spool 23)

By the way, in view of the fact that the spring constant of the coil springs 25 is sufficiently small as compared with the elastic constant k of the fluid spring RP, the spring constant of the coil springs 25 is ignored in the calculation of the natural frequency $\omega_0$ for facilitating the understanding of the third embodiment.

Figure 32:
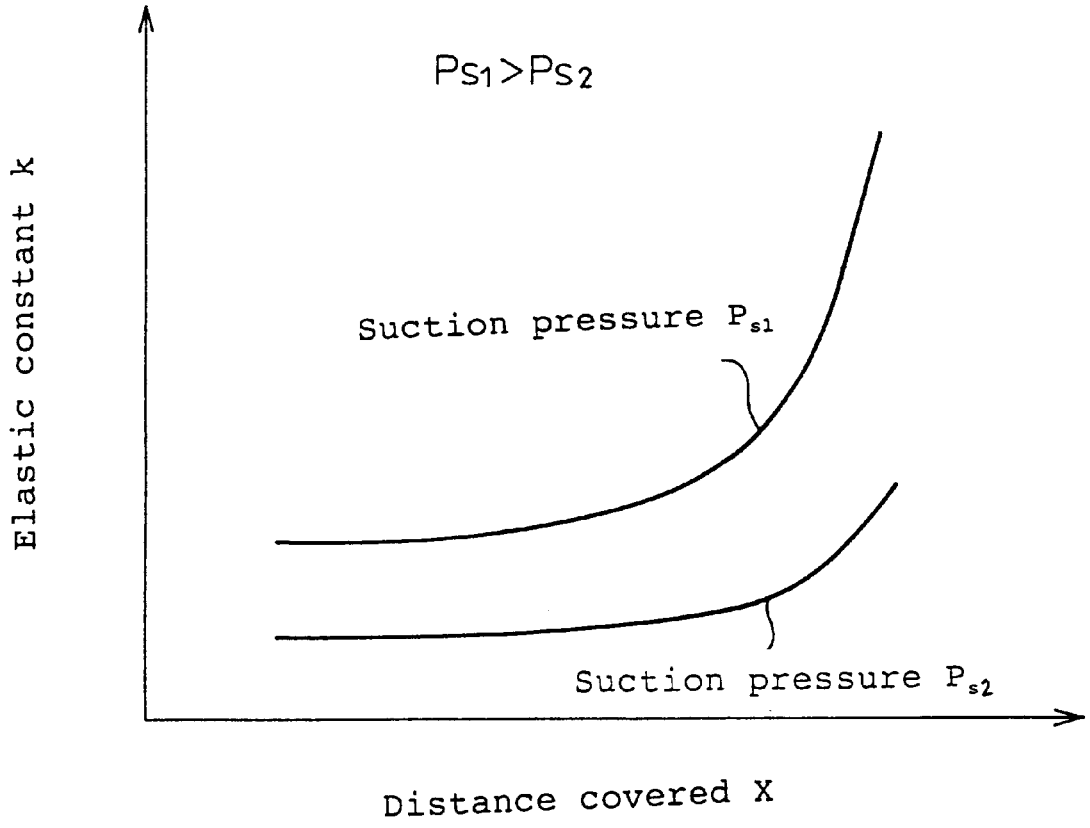
FIG. 32 is a graph showing the relation between the distance covered X and the elastic constant k with the suction pressure as a parameter.
Figure 33:
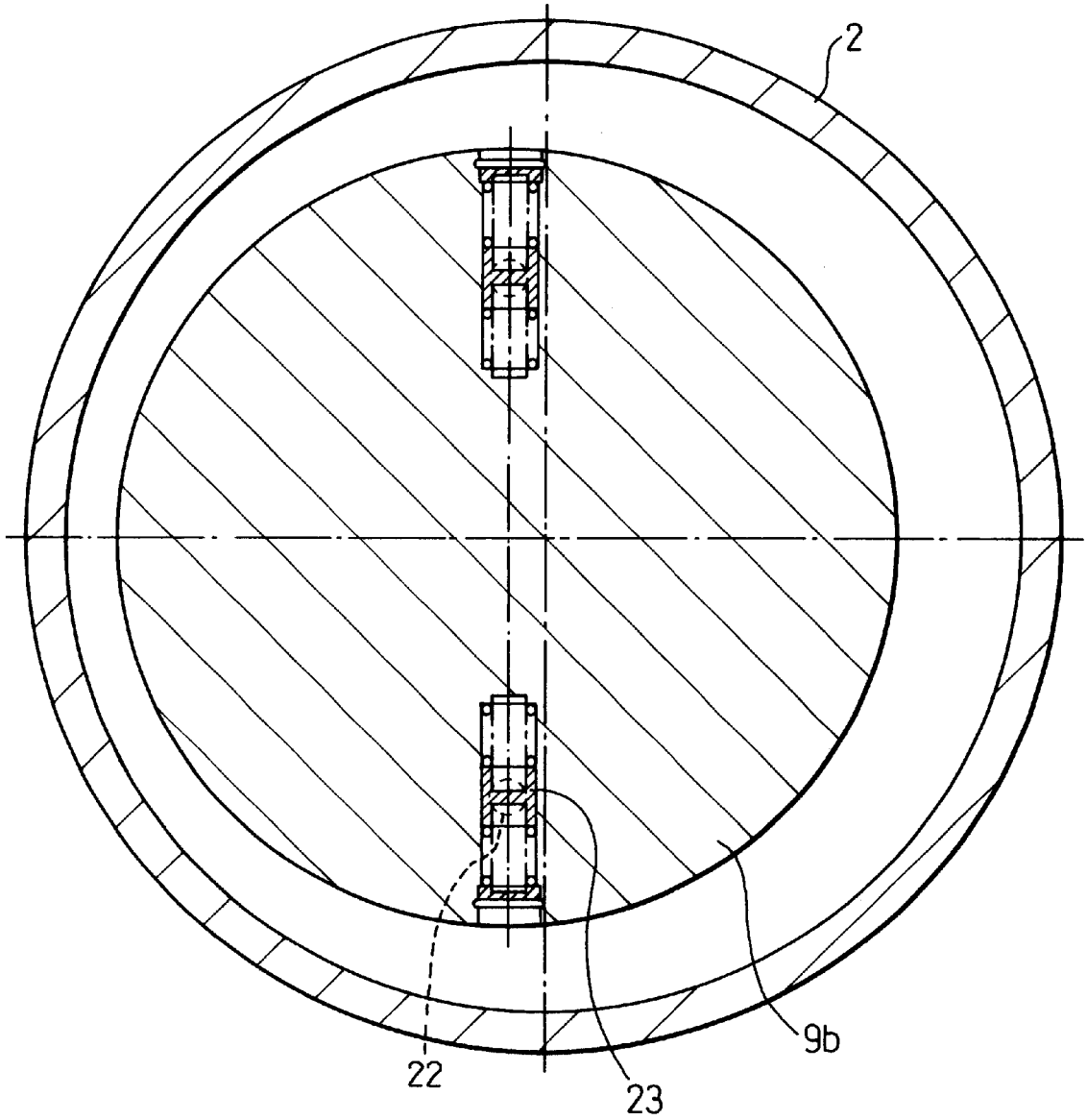
FIG. 33 is a sectional view taken in line E—E in FIG. 30 showing the operating condition $\lambda<1$ of a variable capacity-type scroll compressor according to the third embodiment.
Figure 34:
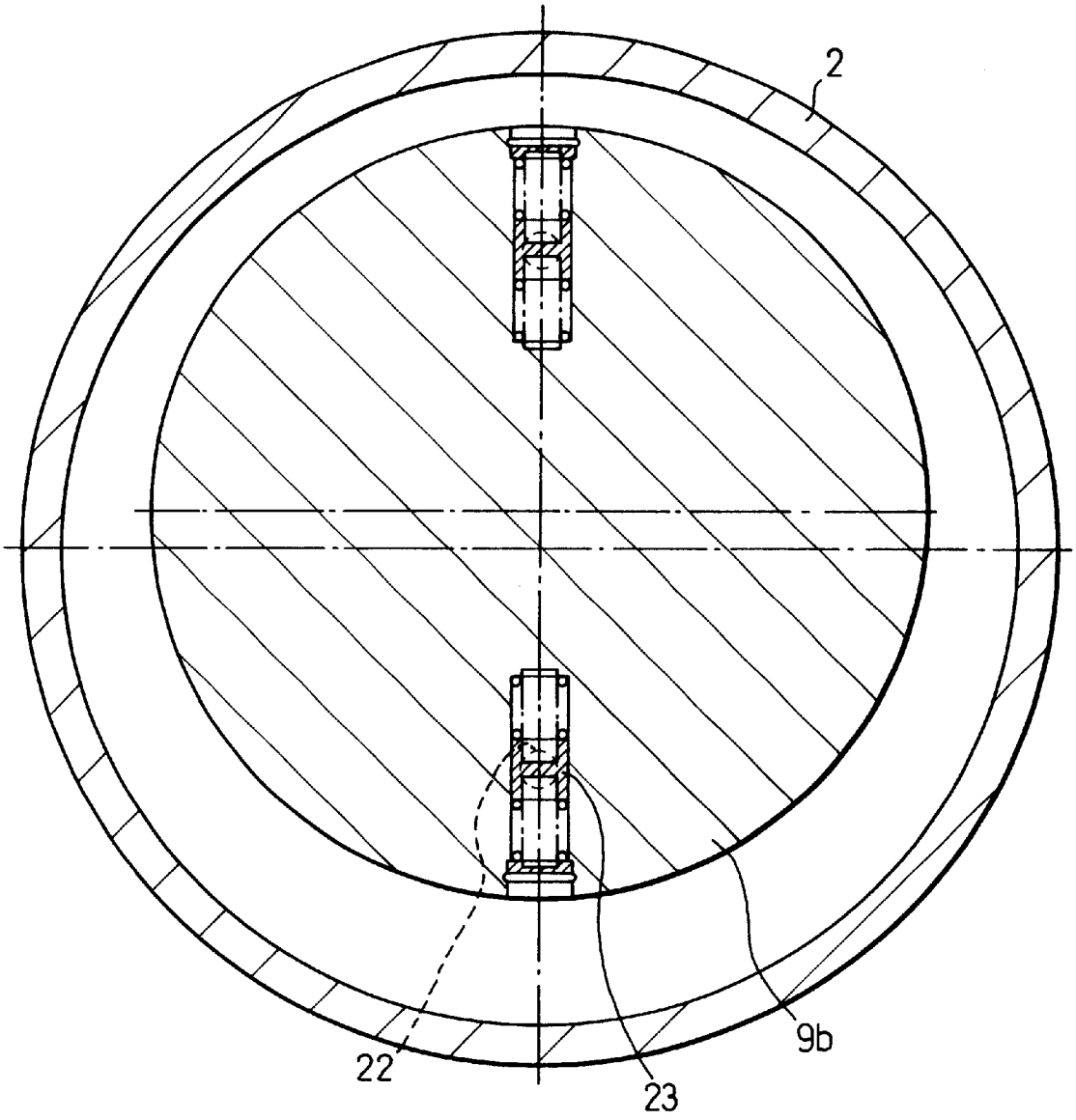
FIG. 34 is a sectional view taken in line E—E in FIG. 30 showing the state in which the movable scroll has orbited by 90° from the state of FIG. 33.
Figure 35:
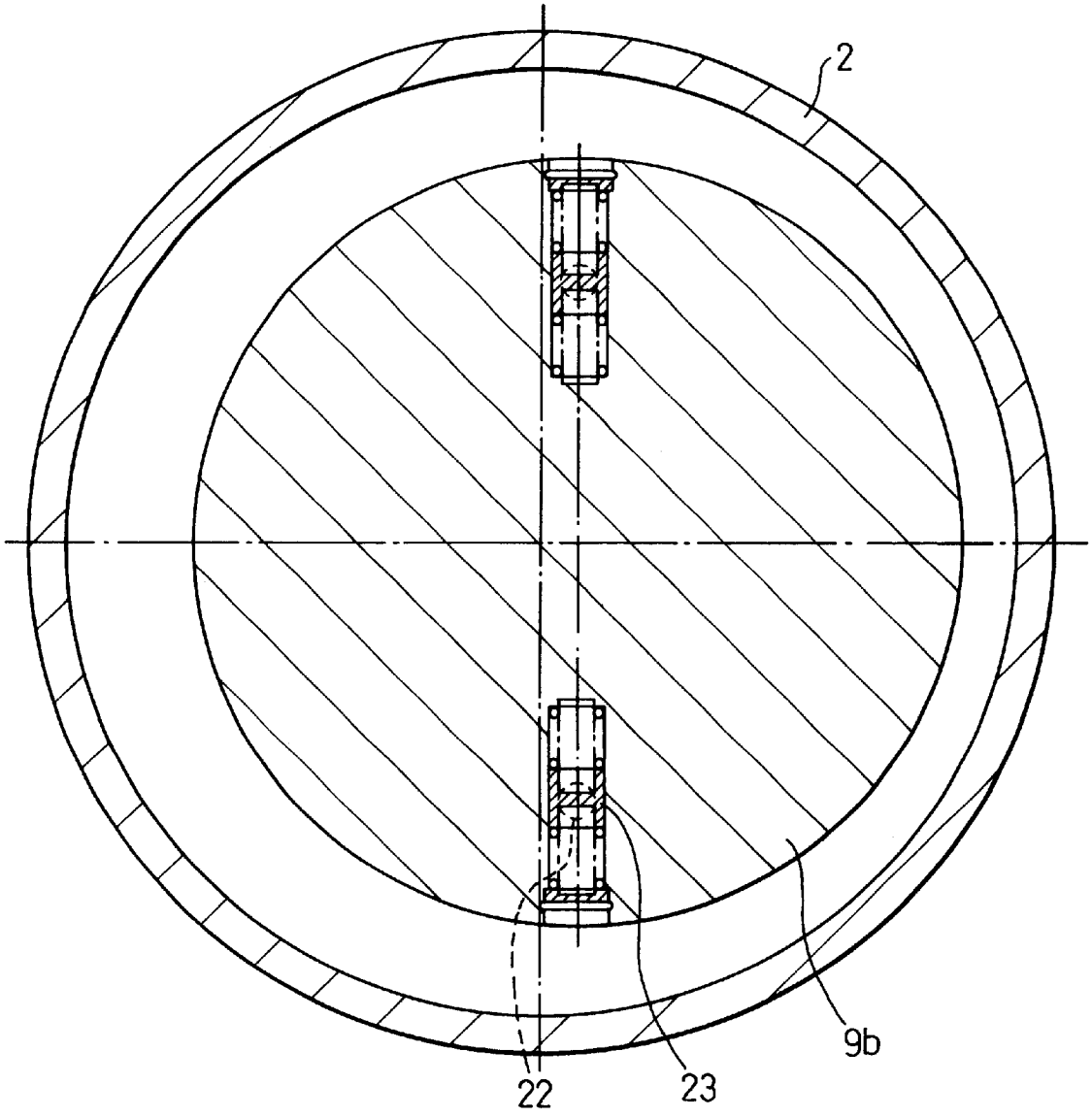
FIG. 35 is a sectional view taken in line E—E in FIG. 30 showing the state in which the movable scroll has orbited by 90° from the state of FIG. 34.
Figure 36:
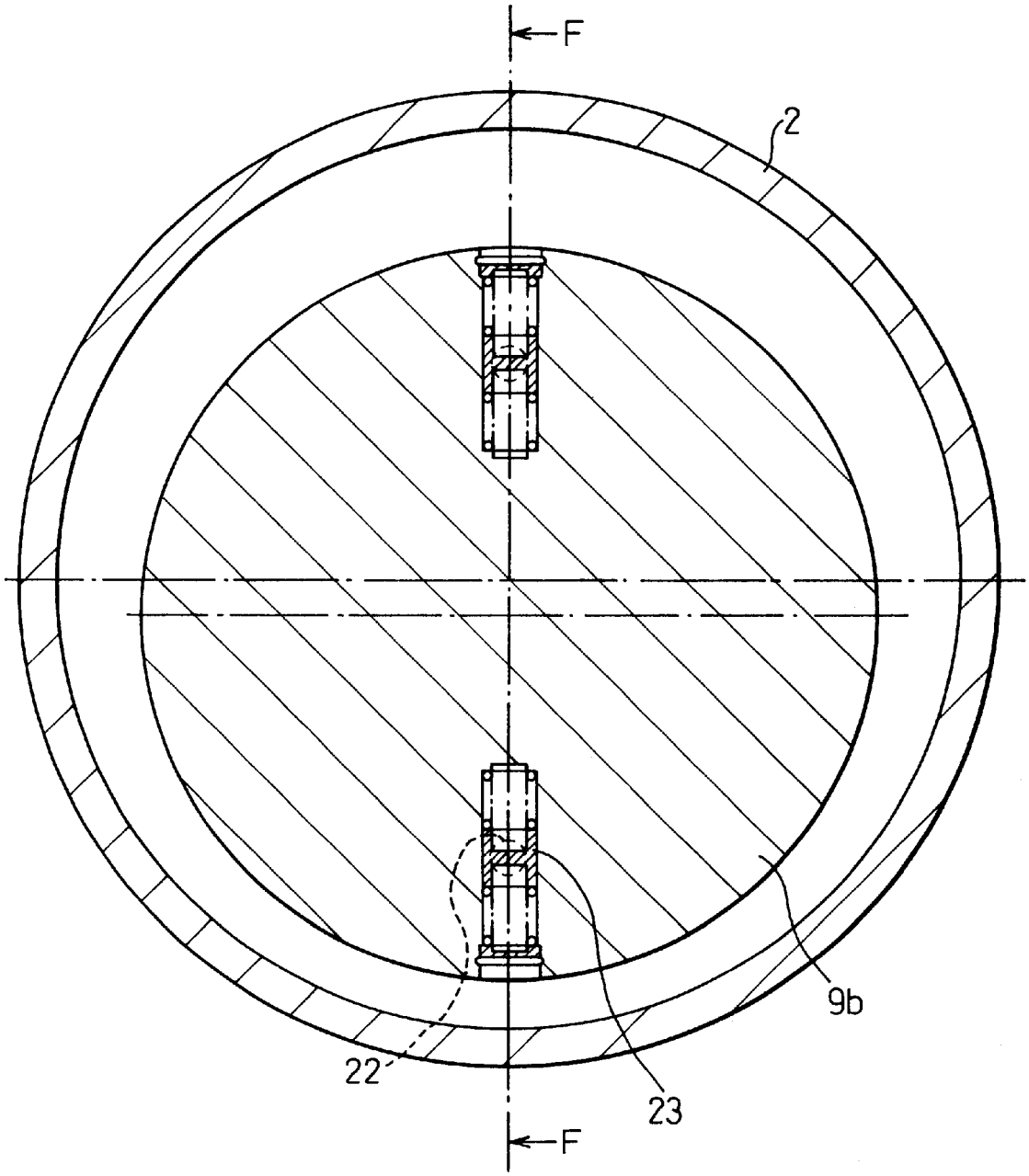
FIG. 36 is a sectional view taken in line E—E in FIG. 30 showing the state in which the movable scroll has orbited by 90° from the state of FIG. 35.
Figure 37:
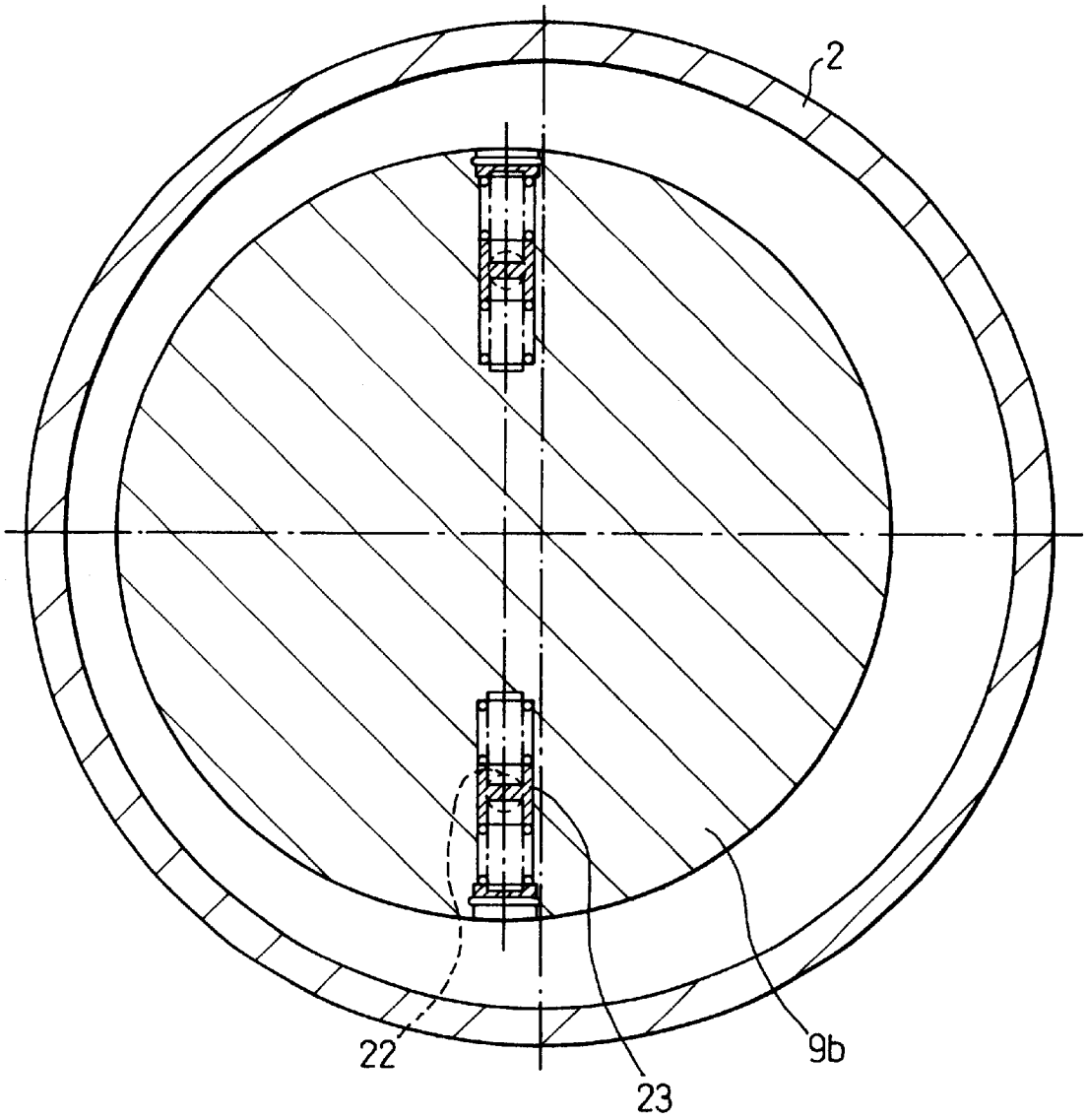
FIG. 37 is a sectional view taken in line E—E in FIG. 30 showing the operating condition $\lambda>1$ of a variable capacity-type scroll compressor according to the third embodiment.
Figure 38:
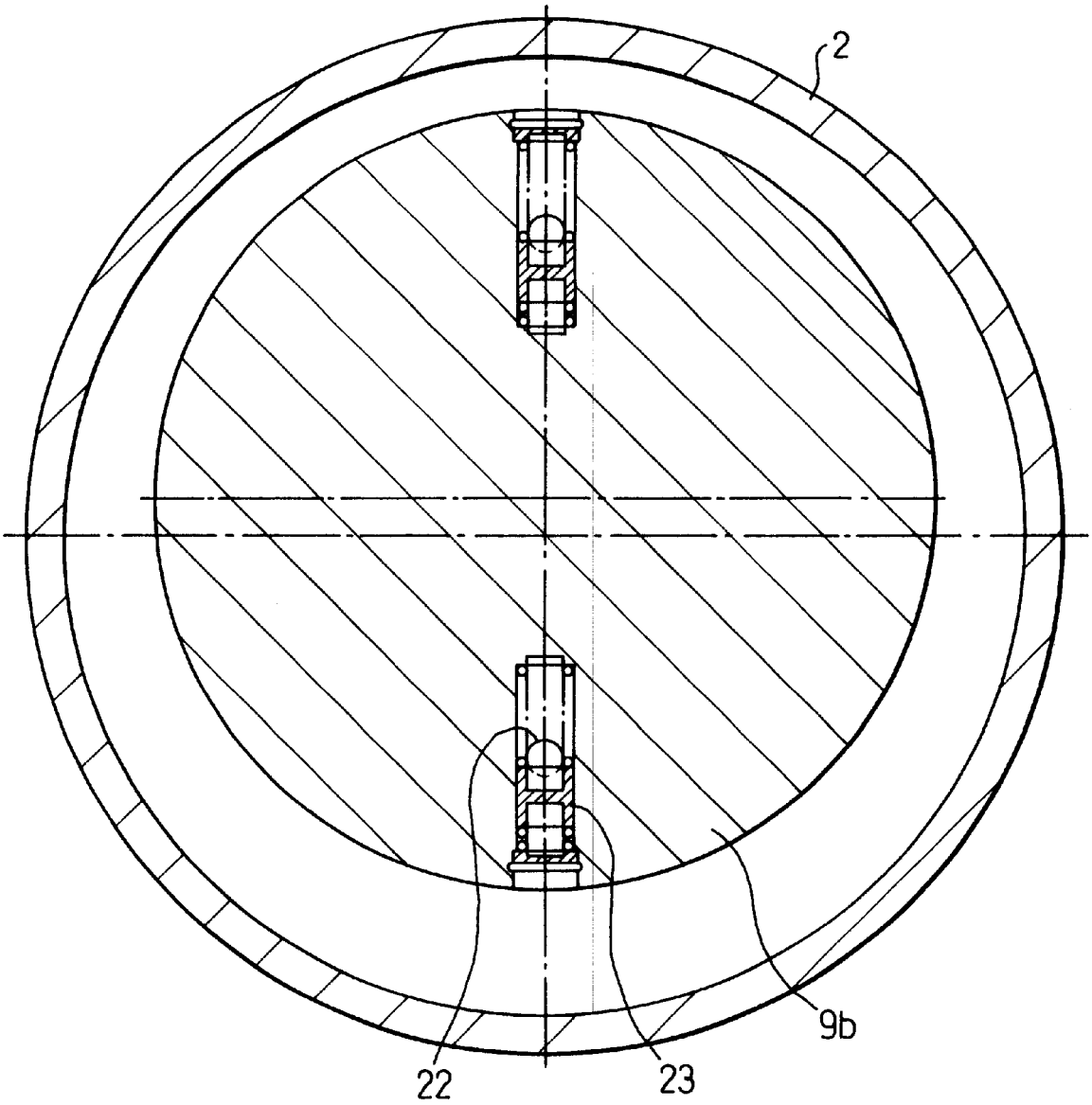
FIG. 38 is a sectional view taken in line E—E in FIG. 30 showing the state in which the movable scroll has orbited by 90° from the state of FIG. 37.
Figure 39:
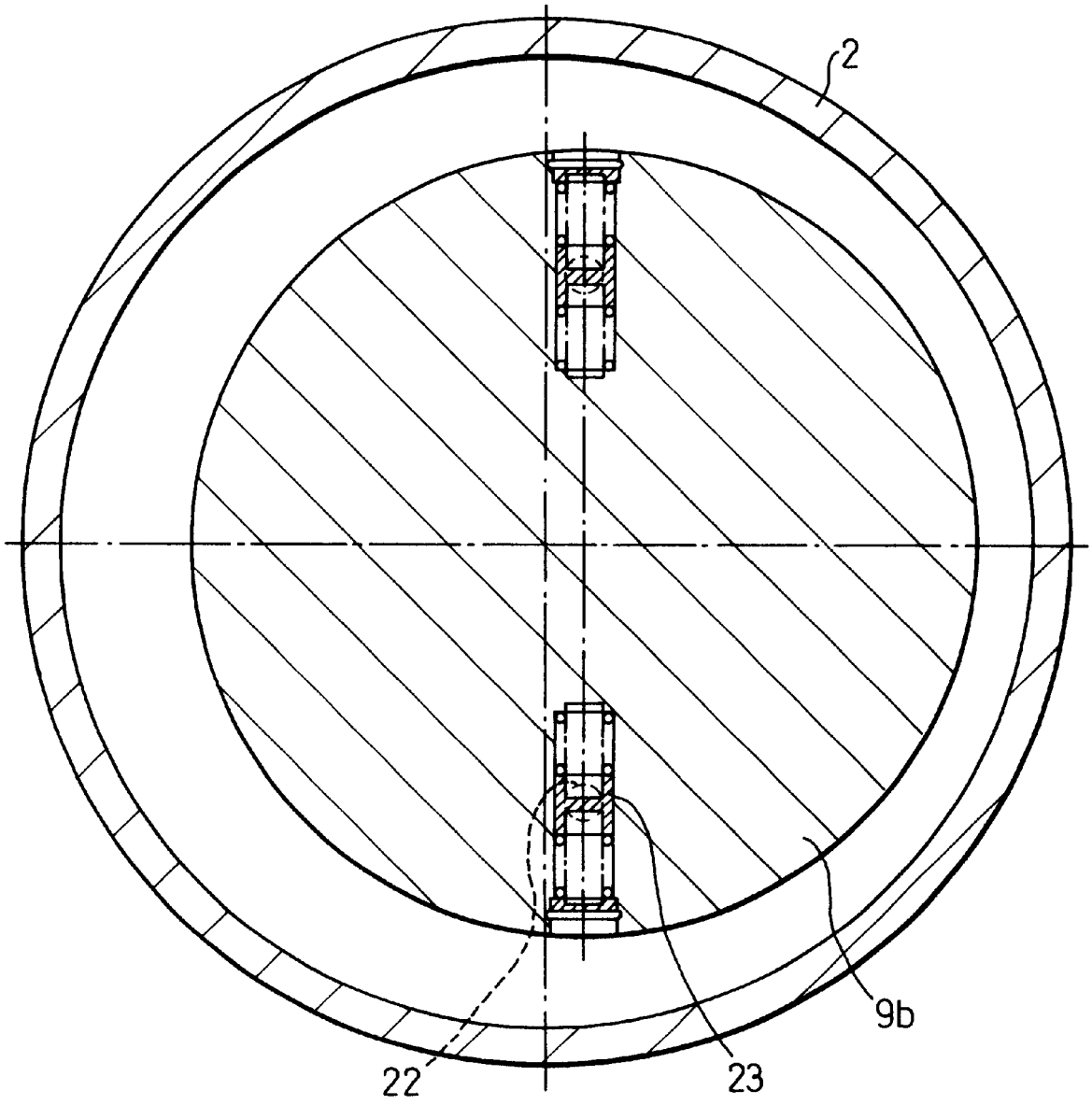
FIG. 39 is a sectional view taken in line E—E in FIG. 30 showing the state in which the movable scroll has orbited by 90° from the state of FIG. 37.
Figure 40:
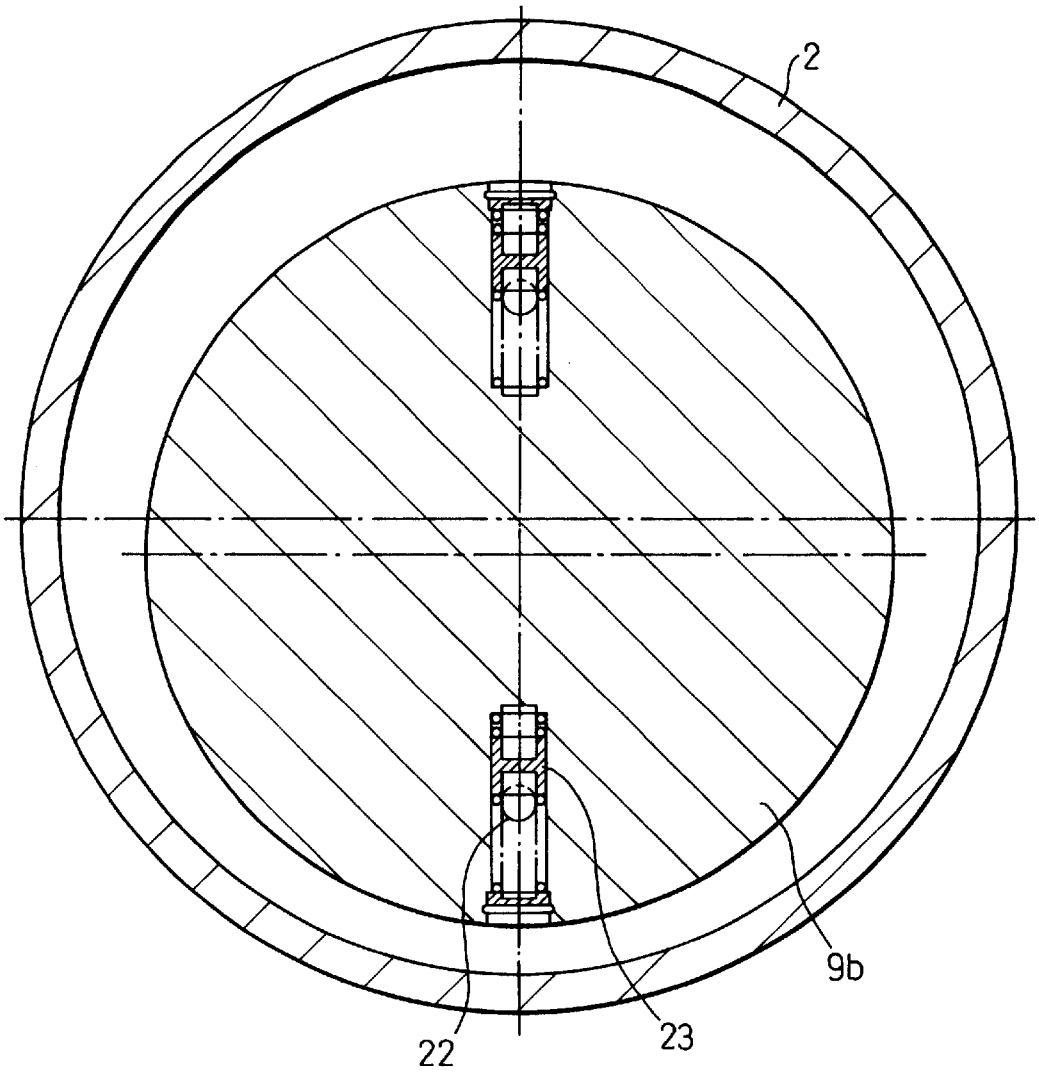
FIG. 40 is a sectional view taken in line E—E in FIG. 30 showing the state in which the movable scroll has orbited by 90° from the state of FIG. 38.

FIG. 32 is a graph showing the relation between the distance covered (displacement) x and the elastic constant k of the fluid spring RP with the internal pressure $P_s$ of the suction chamber 15 (hereinafter referred to as the suction pressure $P_s$) as a parameter. As is clear from this graph, the higher the suction pressure $P_s$, the larger the elastic constant k of the fluid spring RP.

Now, the features and the operation of the third embodiment will be explained.

As in the first embodiment, in the case where the rotational speed $\omega$ of the shaft 4 is sufficiently smaller than the natural frequency $\omega_0$ determined by the fluid spring RP and the mass of the spool 23, the bypass holes 22 are closed (See FIGS. 33 to 36).

In the case where the rotational speed $\omega$ is larger than the natural frequency $\omega_0$, on the other hand, the bypass holes 22 alternate between open and closed states (See FIGS. 37 to 40), so that the volume of the refrigerant sucked into the working chamber V constitutes the amount sucked during the period from the time point when the bypass holes 22 are closed to the time point when the volume of the working chamber V begins to decrease, and the discharge capacity of the compressor 300 decreases (changes).

By the way, in the case where the rotational speed $\omega$ of the shaft 4 is larger than the natural frequency $\omega_0$, the bypass holes 22 are opened by the movement (displacement) of the spool 23. When the bypass holes 22 are opened, the spacing 24*a* communicates with the suction chamber 15 through the working chamber V, so that refrigerant having a pressure substantially equal to the suction pressure $P_s$ is introduced into the spacing 24*a*.

On the other hand, in view of the fact that the suction pressure Ps increases with the increase in the thermal load of the evaporator 130 (FIG. 42) as well known, the value of the natural frequency $\omega_0$ also increases with the increase in the thermal load of the evaporator 130.

Figure 41:
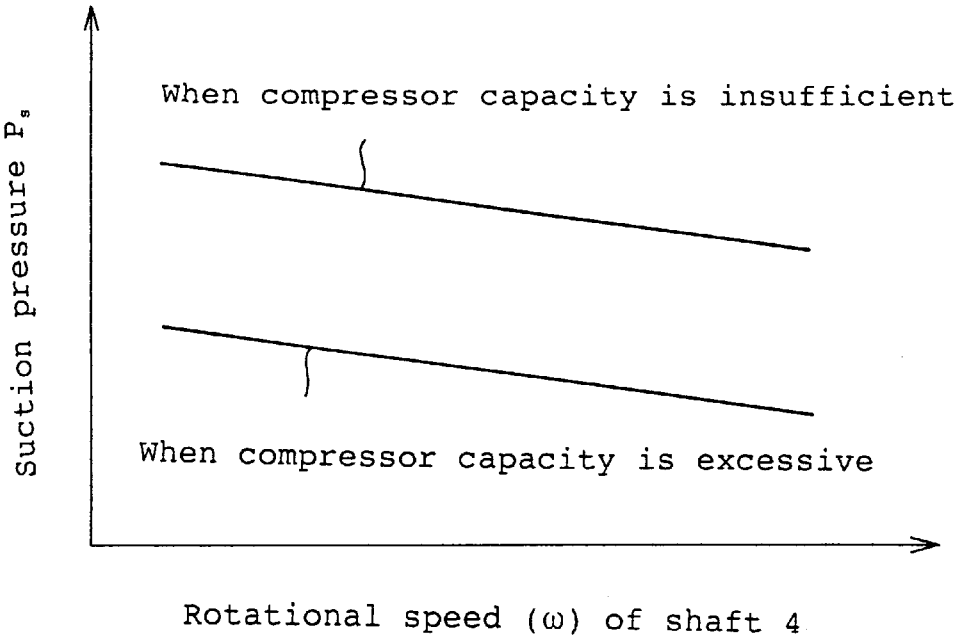
FIG. 41 is a graph showing the relation between the suction pressure Ps and the rotational speed according to the third embodiment.

As a result, when the refrigeration capacity is insufficient due to an increased thermal load, the natural frequency $\omega_0$ increases to such an extent that even when the rotational speed $\omega$ of the shaft 4 increases, the bypass holes 22 can be kept closed (maximum capacity operation). In other words, when the refrigeration capacity is insufficient, the maximum capacity operation is possible with a large rotational speed (orbital vibration frequency of the movable scroll 9) $\omega$ of the shaft 4 of the compressor 300, and therefore a shortage in the refrigeration capacity can be obviated quickly (See FIG. 41).

When the refrigeration capacity is excessive, on the other hand, the natural frequency $\omega_0$ also decreases with the decrease in the suction pressure $P_s$, and therefore the variable capacity operation is possible at a low rotational speed $\omega$. Consequently, when the refrigeration capacity is excessive, the maximum capacity operation is switched to the variable capacity operation quickly. Therefore, the power consumption of the compressor 300 can be reduced (See FIG. 41).

By the way, according to the third embodiment, the 15 timing of switching from the maximum capacity operation to the variable capacity operation is controlled utilizing the fact that the suction pressure $P_s$ changes in accordance with the thermal load of the refrigeration cycle. As is well known, the suction pressure $P_s$ is substantially proportional to the refrigerant temperature in the suction chamber 15. Therefore, according to the third embodiment, it can be said that the elastic constant k of the fluid spring RP constituting an elastic member for exerting elasticity on the spool 23 is configured to change in accordance with the refrigerant temperature in the suction chamber 15 (suction side).

As a result, in the case where the elastic constant k of the elastic member for exerting elasticity on the spool 23 is changed in accordance with the refrigerant temperature in the suction chamber 15 (suction side), the coil springs 25 may be formed of a shape memory alloy which changes the shape thereof in accordance with the atmospheric temperature, in place of the fluid spring RP.

By the way, in this case, in order to improve the responsiveness of the coil springs 25 of a shape memory alloy changing the shape thereof with temperature change, the coil springs 25 are desirably arranged in such a manner that they may be directly exposed to the refrigerant in the suction chamber 15 (suction side).

Also, in the case where the coil springs 25 are used as an elastic member in each of the embodiments described above, a fluid spring RP like an air spring, an accordion bellows or other spring means can be used in place of the coil springs 25.

Also, although each of the aforementioned embodiments is so configured that the spool 23 for opening/closing the bypass holes 22 receives the vibratory force from the movable scroll 9, the vibratory crank portion rotated with the shaft 4 for exerting the vibratory force on the spool 23 may be provided independently of the movable scroll 9.

Indistrial Applicability

As is apparent from the foregoing description, in a variable capacity-type compressor according to the present invention, the spool (23) is forcibly vibrated by the vibratory force derived from the centrifugal force generated with the rotation of the shaft (4) thereby to open and close the bypass holes (22) for establishing communication between the working chamber (V) and the suction side. This compressor, therefore can find applications in many fields including not only a refrigerant compressor of a climate control system but an air compressor for an air pump or charger (turbo charger or supercharger) as well.

What is claimed is:

1. A variable capacity-type scroll compressor for sucking and compressing a fluid by increasing and decreasing the volume of a working chamber (V) formed by a movable scroll (9) and a fixed scroll (16), comprising:

bypass holes (22) formed in the end plate portion (9*b*) of said movable scroll (9), and being able to communicate between said working chamber (V) and a fluid suction side;

a valve body (23) built in the end plate portion (9*b*) of said movable scroll (9), and supported displaceably with respect to said bypass holes (22) in order to intermittently open and close said bypass holes (22); and a shaft (4) rotated for orbiting said movable scroll (9);

characterized in that said valve body (23) is forcibly vibrated under the vibratory force generated with the rotation of said shaft (4) through an elastic member (25) to intermittently open and close the bypass holes.

2. A variable capacity-type compressor as described in claim 1, characterized in that the elastic constant of said elastic member is adapted to change in accordance with the fluid temperature on said fluid suction side.

3. A variable capacity-type compressor as described in claim 1, characterized in that said elastic member is a fluid spring by introducing a fluid from said fluid suction side.

4. A variable capacity-type compressor as described in claim 2, characterized in that said elastic member is a fluid spring by introducing a fluid from said fluid suction side.

5. A variable capacity-type compressor as described in claim 1, characterized in that said elastic member is formed of a shape memory alloy which changes in shape in accordance with the atmospheric temperature and which is disposed at a position directly exposed to the fluid on said fluid suction side.

6. A variable capacity-type compressor as described in claim 2, characterized in that said elastic member is formed of a shape memory alloy which changes in shape in accordance with the atmospheric temperature and which is disposed at a position directly exposed to the fluid on said fluid suction side.

7. A variable capacity-type compressor as described in claim 1, characterized in that said valve body (23) and said elastic member (25) each include a plurality of units (23*a*, 23*b*; 25*a*, 25*b*), and the natural frequencies ($\omega_0$) determined by the elastic constant of said valve body units (23*a*, 23*b*) and said elastic member units (25*a*, 25*b*) are set differently from each other.

8. A variable capacity-type compressor as described in claim 1, characterized in that said valve body (23) is set to close said bypass holes (22) when said shaft (4) is stationary.

9. A variable capacity-type scroll compressor for sucking and compressing a fluid by increasing and decreasing the volume of a working chamber formed in a housing, comprising:

a fixed scroll fixed in said housing for constituting a part of said working chamber;

a movable scroll constituting said working chamber with said fixed scroll for increasing and decreasing the volume of said working chamber by being displaced with respect to said fixed scroll;

bypass holes for establishing communication between said working chamber and the fluid suction side;

a valve body displaceably with respect to said bypass holes in order to intermittently open and close said bypass holes; and a shaft for driving said movable scroll;

characterized in that said valve body is forcibly vibrated by receiving the vibratory force generated with the rotation of said shaft through an elastic member thereby to intermittently open and close said bypass holes.

* * * * *

UNITED STATES PATENT AND TRADEMARK OFFICE

CERTIFICATE OF CORRECTION

PATENT NO. : 6,244,834 B1
DATED : June 12, 2001
INVENTOR(S) : Matsuda et al.

It is certified that error appears in the above-identified patent and that said Letters Patent is hereby corrected as shown below:

Title page,
Insert item -- [63] Continuation of application No. PCT/JP98/03792, Aug. 26, 1998 --

Signed and Sealed this

Second Day of April, 2002

*Attest:*

*Attesting Officer*

JAMES E. ROGAN
*Director of the United States Patent and Trademark Office*